US007266328B2

(12) United States Patent
Ozawa et al.

(10) Patent No.: US 7,266,328 B2
(45) Date of Patent: Sep. 4, 2007

(54) IMAGE FORMING APPARATUS HAVING A CLEANING MECHANISM

(75) Inventors: Yoshio Ozawa, Osaka (JP); Hidehisa Konishi, Mie (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 11/483,362

(22) Filed: Jul. 7, 2006

(65) Prior Publication Data

US 2006/0251444 A1 Nov. 9, 2006

Related U.S. Application Data

(62) Division of application No. 11/260,782, filed on Oct. 27, 2005, now abandoned, which is a division of application No. 10/280,134, filed on Oct. 24, 2002, now Pat. No. 7,079,790.

(30) Foreign Application Priority Data

| | | |
|---|---|---|
| Oct. 26, 2001 | (JP) | 2001-329393 |
| Dec. 3, 2001 | (JP) | 2001-368742 |
| Dec. 6, 2001 | (JP) | 2001-372615 |
| Dec. 25, 2001 | (JP) | 2001-392005 |
| Dec. 27, 2001 | (JP) | 2001-398474 |

(51) Int. Cl.
*G03G 15/20* (2006.01)
*G03G 15/16* (2006.01)

(52) U.S. Cl. ..... 399/123; 399/101

(58) Field of Classification Search ..... 399/101, 399/110, 113, 121, 123, 302, 308, 343, 358, 399/360

See application file for complete search history.

(56) References Cited

U.S. PATENT DOCUMENTS

| | | | | |
|---|---|---|---|---|
| 4,616,920 | A | 10/1986 | Itoigawa et al. | |
| 4,739,371 | A | 4/1988 | Ray et al. | |
| 5,061,961 | A | 10/1991 | Jacobs et al. | |
| 5,132,740 | A * | 7/1992 | Okamoto et al. | 399/360 |
| 5,376,999 | A | 12/1994 | Hwang | |
| 5,585,903 | A | 12/1996 | Mammino et al. | |
| 6,167,223 | A | 12/2000 | Fiore et al. | |
| 6,185,394 | B1 | 2/2001 | Lee | |
| 6,185,395 | B1 | 2/2001 | Lee | |
| 6,233,415 | B1 | 5/2001 | Pang | |
| 6,259,880 | B1 | 7/2001 | Jia et al. | |
| 6,311,036 | B1 | 10/2001 | Jia et al. | |

(Continued)

FOREIGN PATENT DOCUMENTS

| | | |
|---|---|---|
| JP | 7098547 | 4/1995 |

(Continued)

*Primary Examiner*—Sandra L. Brase
(74) *Attorney, Agent, or Firm*—Joel E. Lutzker; John C. Garces; Schulte Roth & Zabel LLP

(57) ABSTRACT

An image forming apparatus having a cleaning mechanism for cleaning paper powder or toner pressed and remaining on the surface of the circumference of an endless belt is provided. The cleaning mechanism includes a rotational shaft part that is detachably and rotatably attached to a supporting frame. The supporting frame of the cleaning mechanism is turned with the rotation of the rotational shaft part so that the supporting frame of the cleaning mechanism faces the belt supporting frame, fixing both frames at a point where a cleaning member presses the surface of the circumference of the endless belt.

6 Claims, 20 Drawing Sheets

U.S. PATENT DOCUMENTS

| | | | | |
|---|---|---|---|---|
| 6,321,052 | B1 | 11/2001 | Yamashina et al. | |
| 6,463,236 | B2 | 10/2002 | Morikami et al. | |
| 6,704,528 | B1 * | 3/2004 | Kawamura et al. | 399/123 |
| 6,757,512 | B2 * | 6/2004 | Miyawaki et al. | 399/302 X |

FOREIGN PATENT DOCUMENTS

| | | |
|---|---|---|
| JP | 8087151 | 4/1996 |
| JP | 8123294 | 5/1996 |
| JP | 08-194387 | 7/1996 |
| JP | 9277608 | 10/1997 |
| JP | 10240020 | 9/1998 |
| JP | 10260593 | 9/1998 |
| JP | 2000019861 | 1/2000 |
| JP | 2000321953 | 11/2000 |
| JP | 2000352852 | 12/2000 |
| JP | 2001249508 | 9/2001 |
| JP | 2001282010 | 10/2001 |
| JP | 2001324848 | 11/2001 |
| JP | 2001324854 | 11/2001 |
| JP | 2001343838 | 12/2001 |

* cited by examiner

Fig.20

| | Base material layer | Elastic material layer | Releasing material layer | T1 (mm) | T2 (mm) | A (%) | B (%) | A+B | Image without midsection | Color drift | 100,000 sheets durability |
|---|---|---|---|---|---|---|---|---|---|---|---|
| Example 1 | PVdf (100 μ) | CR (390 μ) | Aqueous polyfulurocarbon latex (10 μ) | 11 | 0.5 | 4.34 | 2 | 6.34 | ○ | ○ | ○ |
| Example 2 | 66 (100 μ) | ↑ | ↑ | 11 | 0.5 | 4.34 | 4 | 8.34 | ○ | ○ | ○ |
| Comparative example 1 | ↑ | ↑ | ↑ | 17 | 0.5 | 2.85 | 4 | 6.85 | ○ | ○ | ○ |
| Comparative example 2 | Thermoplastic elastomer (100 μ) | ↑ | ↑ | 22 | 0.5 | 2.22 | 15 | 17.22 | ○ | × | △ |
| Example 3 | PVdf (100 μ) | CR (590 μ) | ↑ | 11 | 0.7 | 5.98 | 2 | 7.98 | ○ | ○ | ○ |
| Comparative example 3 | Polyimide (100 μ) | - | - | 11 | 0.1 | 0.90 | 0 | 0.90 | △ | ○ | × |

IMAGE FORMING APPARATUS HAVING A CLEANING MECHANISM

CROSS-REFERENCE TO RELATED APPLICATIONS

This application is a divisional of application Ser. No. 11/260,782, filed Oct. 27, 2005 now abandoned, which application is a divisional of application Ser. No. 10/280,134, filed Oct. 24, 2002 now U.S. Pat. No. 7,079,790.

BACKGROUND OF THE INVENTION

The present invention relates to an image forming apparatus by an electro-photography process such as a copying machine, a printer or a facsimile. More particularly, the present invention relates to an image forming apparatus which forms images utilizing an endless belt such as an endless intermediate transfer body.

Generally, an electro-photographic image forming apparatus (hereinafter referred to as an image forming apparatus) which utilizes an endless belt of an intermediate transfer body (hereinafter referred to as an intermediate transfer belt) to form color images using an electro-photography process is known in the art. In the image forming apparatus, a plurality of image forming units are disposed along an intermediate transfer belt and a second transfer roller is disposed at the downstream of the rotational direction of the intermediate transfer belt.

A conventional image forming apparatus is shown in FIG. 1. The conventional image forming apparatus has a plurality of image forming units 11-14, each respectively comprising a photosensitive body drum 11*a*-14*a* and a toner container 11*b*-14*b*. Image forming units 11, 12, 13 and 14 correspond to yellow (Y), magenta (M), cyan (C) and black (K), respectively. These image forming units, more specifically the photosensitive body drums, are disposed along the transporting direction of intermediate transfer belt 21 (a transporting pathway) so that photosensitive body drum 11*a* is disposed at the most upstream position of the transporting pathway and photosensitive body drum 14*a* is disposed at the most downstream position of the transporting pathway. Primary transfer rollers (not shown) are each disposed facing photosensitive body drums 11*a*-14*a*.

Intermediate transfer belt 21 is supported by a driving roller 22*a*, a supporting roller 22*b*, a tension roller 23 and a backup roller 24. Intermediate transfer belt 21 is driven in the direction of the solid arrow head line shown in FIG. 1 by driving roller 22*a*, while being applied a predetermined tension by tension roller 23. Backup roller 24 faces a secondary transfer roller 25. A primary transfer part is defined between driving roller 22*a* and supporting roller 22*b* along which said image forming units 11, 12, 13 and 14 are disposed.

When images are formed, toner images are formed on photosensitive body drums 11*a*-14*a* synchronized with the movement of intermediate transfer belt 21. Primary transfer images are formed by primarily transferring the toner images on intermediate transfer belt 21. A recording medium (not shown) is sent from a paper supplying unit 27 to a secondary transferring position by being transported on a recording media transporting belt 29 with a paper reversing roller 28. The recording medium is sandwiched together with intermediate transfer belt 21 between backup roller 24 and secondary transfer roller 25, the toner images (primary transfer images) being secondarily transferred on the recording medium by secondary transfer roller 25. Subsequently, the recording medium is transported to a fixing device 30, where the images are fixed, and then discharged to a discharge tray 31. A recording medium may also be placed on the recording media transporting belt 29 by using manual inserting roller 28*a*.

The image forming apparatus shown in FIG. 1 has a primary transfer part where intermediate transfer belt 21 is horizontally disposed, which results in the space occupied by the belt becoming unnecessarily large. Accordingly, volumes of toner hoppers, each storing a different colored toner, require frequent monitoring and equalization. For example, it is necessary to replenish black toner more frequently than other colored toners.

To avoid such drawbacks, an image forming apparatus is provided, for example, in Japanese laid-open patent publication JP1996-87151. In such apparatus, a transporting pathway for recording media, which are transported through a plurality of image forming units, is inclined with respect to the horizontal direction.

The former image forming apparatus having the aforementioned intermediate transfer belt 21, driving roller 22*a*, supporting roller 22*b*, tension roller 23, backup roller 24 and the primary transfer roller are fixed to an intermediate transfer belt supporting frame to compose an intermediate transfer belt unit. Tension roller 23 is disposed between supporting roller 22*b* and backup roller 24. Since tension roller 23 applies a tension toward intermediate transfer belt 21, it presses the belt in the direction shown by the dashed arrowhead line in FIG. 1. As a result of the applied tension, intermediate transfer belt 21 becomes inflated in the direction of the dashed arrowhead line.

In FIG. 1, intermediate transfer belt 21 is horizontally disposed in the primary transfer part and backup roller 24 is disposed under the primary transfer part and between driving roller 22*a* and supporting roller 22*b*. Consequently, the intermediate transfer belt unit extends in the left and the right directions resulting in a large intermediate transfer belt unit.

Since fixing device 30 is disposed down stream of and under the intermediate transfer belt unit and recording media transporting belt 29 moves between secondary transfer roller 25 and backup roller 24, if the intermediate transfer unit becomes large in size, the image forming apparatus itself becomes large in size. That is to say that the image forming apparatus shown in FIG. 1 will require a larger image forming apparatus casing 32 as the intermediate transfer belt unit becomes larger in size. As a result, unused or dead space in the casing increases. Furthermore, as intermediate transfer belt 21 needs at least four rollers (i.e., driving roller 22*a*, supporting roller 22*b*, tension roller 23, backup roller 24), as well as the primary transfer roller, the apparatus inevitably becomes heavy.

Apart from that, since backup roller 24 is disposed under the primary transfer part and between driving roller 22*a* and supporting roller 22*b*, while tension roller 23 is disposed between supporting roller 22*b* and backup roller 24, the angle created between intermediate transfer belt 21 and recording media transporting belt 29 is small and makes it difficult to separate the recording media from intermediate transfer belt 21. Due to the difficulty of separating the recording media, a media separating mechanism (not shown) needs to be provided.

As seen from the design of the image forming apparatus in FIG. 1, no consideration is given to the compactness of the design nor to the separation of recording media. Meanwhile, Japanese laid-open patent publication JP 1996-87151 discloses an image forming apparatus without an intermediate transfer belt. Accordingly, the apparatus lacks advantages provided by an image forming apparatus with an intermediate transfer belt, such as, obtaining images without color drift and accepting various forms of media (e.g., thin paper, thick paper, transparent material or label paper) without restriction. Furthermore, the direct transfer operation of JP 1996-87151 forces a design limitation where a fixing device needs to be on the same line as a transporting pathway for recording media.

As described earlier, driving roller 22*a*, supporting roller 22*b*, tension roller 23, backup roller 24 and the primary transfer roller are supported on the supporting frame to compose the intermediate transfer belt unit, which supports endless intermediate transfer belt 21. Endless intermediate transfer belt 21 also transports the recording medium.

Intermediate transfer belt 21 can not be mounted to the intermediate transfer belt unit, unless the outer circumference of the surface of the intermediate transfer belt unit, which contacts the intermediate transfer belt, is smaller than the inner circumference of intermediate transfer belt 21. When mounting intermediate transfer belt 21, workers must be careful not to damage the surface of intermediate transfer belt 21.

For this reason, a large difference in dimension between the outer circumference of the surface of the intermediate transfer belt unit and the inner circumference of intermediate transfer belt 21 needs to be provided. A tension roller is necessary to remove distortion caused by this large dimensional difference. However, providing the tension roller requires additional mounting space and a mechanism for applying tension. This further contributes to unused space and complicates the structure. The structure becomes heavier due to the increased number of component members, which ultimately leads to increased costs.

The intermediate transfer belt unit has a protective cover mounted in the unit for protecting edges of the intermediate transfer belt. The protective cover is mounted after the intermediate transfer belt is mounted. Accordingly, when the intermediate transfer belt is replaced for maintenance, or when the belt unit is recycled, the protective cover has to be removed in advance. This procedure restricts and complicates maintenance.

To overcome such a drawback, Japanese laid-open patent publication JP1996-123294 discloses an image forming apparatus having a cartridge of an intermediate transfer belt. The cartridge is provided with a supporting member for changing a belt, wherein a tension roller of the intermediate transfer belt is made to be movable against a spring so as to support the intermediate transfer belt. This allows the tension roller to move towards a driving roller when changing the intermediate transfer belt. Thus, the intermediate transfer belt of the apparatus is changeable as a whole cartridge having the supporting member for changing a belt.

However, the apparatus disclosed in Japanese laid-open patent publication JP1996-123294 requires changing a whole cartridge when changing the belt. Not only is the structure complicated but it is also uneconomical and environmentally unfriendly. When changing the belt, the supporting member has to be discarded with the belt.

Another conventional apparatus is disclosed in Japanese patent publication JP3175631 (corresponds to JP1998-260593). The image forming apparatus has a secondary transfer device under and opposite the side of a fixing device from the center of the longitudinal direction of an intermediate transfer belt so as to provide enough distance between the secondary transfer device and the fixing device. There is also a roller for restricting meandering of the belt so as to keep an appropriate tension of the intermediate transfer belt.

However, the additional roller for restricting meandering of the belt in Japanese patent publication JP3175631 enlarges the running region for the intermediate transfer belt and makes it difficult to design a compact apparatus. This inevitably leads to increased costs for the apparatus. Furthermore, when having to change the endless intermediate transfer belt, a cleaning device which cleans paper powder, waste toner or other deposits remaining on the belt is required to be replaced as well.

Ultimate elongation of the belt in the periphery direction needs to be at a minimum. Consequently, an appropriate thickness of the intermediate transfer belt is required, which necessitates hardness of the belt itself. The resultant stiff belt brings about image defects such as an image without midsection. If a rate difference is given between that of an image bearing body and the intermediate transfer body, apparent malfunction of transportation of the belt or color drift occurs. Although an attempt to minimize ultimate elongation of the belt using a material having a high tensile strength such as polyimid resin is done, the material is expensive and hard in its property so that a large nip is necessary when transferring and a high powered motor is necessary to drive the belt accurately.

Japanese laid-open patent publication JP1998-240020 describes an intermediate transfer belt wherein a fibrous substrate is accompanied in rubber to minimize an ultimate elongation of the belt. In addition, a releasing layer is provided on the surface. Though the belt makes a certain level of progress in a point of elongation, soft rubber material is scraped by friction with the driving roller to affect driving performance. In addition, when running for long periods of time the belt will expand and ultimately cause color drift to occur.

SUMMARY OF THE INVENTION

An object of the present invention is to provide an image forming apparatus having an intermediate transfer belt which is compact and provides excellent properties for separating recording medium.

Another object of the present invention is to provide an image forming apparatus capable of allowing easy mounting and removal of an endless intermediate transfer belt on a belt unit.

Yet another object of the present invention is to provide an image forming apparatus having a cleaning device capable of easily being attached and detached when changing the endless intermediate transfer belt.

Yet another object of the present invention is to provide an image forming apparatus that is stable and reliable in providing quality images when operating for extended periods of time without generating elongation or cracking of the intermediate transfer belt.

According to the present invention, an image forming apparatus having a plurality of image forming units and each of which forms a toner image by developing an electrostatic latent image on an image bearing body provided in correspondence to each color, an intermediate transfer body which is transported along a predetermined transport pathway and to which the toner image is transferred in a primary transfer part as a primary transfer image, the image forming units are disposed along the primary transfer part, and in which an image is formed by secondarily transferring the primary transfer image to a recording medium with a secondary transfer roller at a position of a secondary transfer position disposed at downstream side of the primary transfer part, a transporting pathway of the primary transfer part is inclined upwardly in the direction from an image forming unit disposed at the most upstream point to an image forming unit disposed at the most downstream point. The primary transfer part has a first roller which transports the intermediate transfer body, a second roller which gives a tension to the intermediate transfer body and a third roller which confronts the second roller at secondary transfer position. An intermediate transfer body unit comprises the intermediate transfer body, the first roller, the second roller and the third roller where the primary transfer part is defined between the first roller and the second roller.

The intermediate transfer body unit also has a pressing member which presses the second roller toward the outward in the radius direction.

In this way, the image forming apparatus itself not only becomes compact but also a tension roller is unnecessary so that the weight of the intermediate belt unit can be reduced.

In this case, it is preferable to dispose the third roller vertically under the image forming unit disposed at the most upstream point.

In this way, a pressure of a spring of the primary transfer roller does not affect secondary transfer to give an excellent image and a recording medium is easily separated from the intermediate transfer belt owing to an resultant large angle between the intermediate transfer belt and the recording media transporting belt.

For example, each of the image forming units is for yellow, magenta, cyan or black. The image-forming unit disposed at the most upstream point is for black.

As stated above, when a transporting pathway of the primary transfer part is inclined upwardly in the direction from an image forming unit disposed at the most upstream point to an image forming unit disposed at the most downstream point and the image-forming unit disposed at the most upstream point is for black, a good result of transfer is obtained because black toner has a lower melting point than other toners and black toner which is consumed frequently can be stored plentifully.

According to another aspect of the invention, an image forming apparatus has an endless belt and a supporting frame wherein the belt supporting frame is separable into a plurality of units in the orthogonal direction to the transporting direction of the endless belt and each unit is connected and supported so that a connected part is capable of bending in the bending direction of the endless belt. In this way, when mounting or replacing the endless belt to the belt supporting frame, such relation as the outer circumference of the belt contacting surface of the belt supporting frame is smaller than the inner circumference of the belt can be easily obtained. Hence, an image forming apparatus having a low cost frame capable of easily and simply mounting and replacing without damaging the surface of the belt, without increasing cost of adding a structure for changing the belt and without increasing workers' burden can be provided. Since each work for mounting is possible in the separate state, a productivity rate on the assembly line is improved and a turn-around time is shortened.

As a supporting point of bending of the supporting frame is provided at a valley side, the connected part can be bent in such direction as to decrease the outer circumference of the belt contacting surface of the belt supporting frame. Thus, the belt can be easily mounted or removed without damaging the surface of the belt and without separating the belt supporting frame into unit bodies. Consequently, an image forming apparatus having a low cost belt supporting frame can be provided.

Each unit body of the belt supporting frame has a vertical plane on the belt side of the supporting point of bending of the supporting frame. A mutual position between the units is restricted by contacting the planes so as to accurately restrict the position when the bent unit bodies are restored to the original state and to accurately mount the endless belt to the belt supporting frame.

Further, as for the supporting point for bending, a receiving part of the supporting point for bending the unit body has a round part of supporting face when turning the supporting point and a groove part for embedding the supporting point. The supporting point has a round part of approximately the same curvature as the receiving part and a flat part which is embedded to the groove part so that the supporting point which deviates from the groove part turns in the round part of the receiving part of the supporting point. Thus, when the unit bodies are positioned for connecting, the supporting point is easily embedded for the receiving part since the supporting point has the groove part in the innermost of the wide round part. And even though the unit bodies are bent, a turning supporting point turns smoothly without clattering in the round part which is a supporting face of the receiving part of the supporting point. Despite of the separable unit bodies, when the endless belt is mounted, the unit bodies can be bent as they are connected so that the endless belt can be mounted to the supporting frame even in the state that a guard member is attached to protect an edge part of the endless belt.

When the unit bodies are bent, a bending angle of the unit bodies is slightly smaller than an angle at which the supporting point departs from the round part of the receiving part of the supporting point whereby the belt is easily mounted or replaced without separating the unit bodies.

In order to mount the belt to the supporting frame, the belt supporting frame may be capable of separating into a plurality of units in a direction orthogonal to the transporting direction of the endless belt. The plurality of units may also be connected so that they are capable of expanding and contracting in the straining direction of the endless belt.

In this way, a relation that the outer circumference of the belt-contacting-surface of the belt supporting frame is smaller than the inner circumference of the belt can be easily obtained without bending the unit bodies whereby an image forming apparatus having a low cost frame capable of easily and simply mounting and replacing without damaging the surface of the belt, without increasing cost of adding a structure for changing the belt and without increasing workers' burden can be provided.

In case each unit is connected so that a connected part is capable of expanding and contracting in a direction parallel to the straining direction of the endless belt, a protruded part is provided on one of the unit body of the belt supporting frame which contacts to the other unit body each other and a recessed part to which the protruded part is embedded is provided on the other unit body while a member for latching is provided on the opening side of the recessed part, the protruded part is embedded in the recessed part when the endless belt is contracted in the straining direction of the belt and the protruded part is drawn from the recessed part while latching the other protruded part by the member for latching whereby the belt supporting frame is capable of expanding and contracting.

In this manner, the dimension of the outer circumference of the belt-contacting-surface of the belt supporting frame becomes smaller than the inner circumference of the belt without bending the unit bodies whereby an image forming apparatus having a low cost frame capable of easily and simply mounting and replacing without damaging the surface of the belt, without increasing cost of adding a structure for changing the belt and without increasing workers' burden can be provided.

The endless belt constructed in this way is used for primarily transferring thereto an image formed on a photosensitive body and is also used for secondarily transferring the image to a final transferring member after that whereby the intermediate transfer belt is easily mounted and replaced otherwise it is hard to mount the belt to the frame and the belt is susceptible to surface damage because an expand in the circumferential direction is restricted.

When the supporting frame of the endless belt is applied to a supporting frame of an intermediate transfer belt, the belt supporting frame can be bent at the vicinity of the center so as to be able to bend where a total outer circumference of the supporting frame is the most shorter than the inner circumference of the endless belt whereby an image forming apparatus having a low cost frame capable of easily and simply mounting and replacing without damaging the surface of the belt, without increasing cost of adding a structure for changing the belt and without increasing workers' burden can be provided.

When the supporting frame of the endless belt is applied to a supporting frame of an intermediate transfer belt, images can be transferred with uniform pressure at the place without strain and diagonal traveling where the tension is largest by disposing the first primary transfer roller which primarily transfer the images at the position just after the downstream of the supporting roller which gives tension to the belt by pressing with a spring.

Further when the supporting frame of the endless belt is applied to a supporting frame of an intermediate transfer belt, the intermediate transfer belt is hard to be affected by heat generated from a fixing device on account of a cleaning mechanism by disposing the cleaning device which cleans wasted toner on the intermediate transfer belt at the position to be a heat insulating wall for the intermediate transfer belt against heat from the fixing device so that a distance between the fixing device and the secondary transfer roller can be decreased whereby a more compact image forming apparatus can be provided.

In addition, a belt supporting unit is composed by providing a supporting part having a higher supporting point than the surface of the endless belt at both lateral sides in the transporting direction of the endless belt, which protect the edge of the endless belt wherein a area defined by outer peripheral line of the belt supporting unit which is projected from the lateral side of the supporting part at the bent state is smaller than a area formed by the circumference of the endless belt so as to be able to mount or detach the endless belt.

As a area defined by outer peripheral line of the belt supporting unit which is projected from the lateral side of the supporting part at the bent state is smaller than a area formed by the circumference of the endless belt, even though the belt is tight set in such a manner that tension is generated between the driving roller and the tension roller by bending the belt supporting units, a distance of the belt supporting unit between the driving roller and the tension roller becomes short at the bent state so that the belt supporting unit is easily inserted into an elliptical or triangular opening even if there is the supporting part.

The endless belt is also easily mounted or replaced not only by inserting the supporting unit into the opening but also by making one of the supporting parts go through into the lateral opening of the endless belt in such a state that the belt supporting unit is bent as the supporting part is provided.

Further according to another effective embodiment of the present invention, an image forming apparatus comprises a roller supporting member which support a tension roller provided at a supporting part, each supporting member and supporting part at a position of confronting each other having a catching female part and a male part capable of catching and fixing a position of the supporting member utilizing a travel restricting width in the tension direction of the tension roller wherein the catching female part and the male part catch and fix at a region of traveling in the tension direction of the tension roller.

According to the embodiment, the apparatus comprises a roller supporting member which supports the tension roller at a position confronting the roller supporting member of a supporting part protecting the edge of the endless belt having a supporting point higher than the surface of the endless belt when the endless belt is mounted at both lateral sides of transporting direction of the endless belt in the supporting part.

Each supporting member and supporting part at a position of confronting each other is provided a catching female part and a male part capable of catching and fixing a position of the supporting member utilizing a travel restricting width in the tension direction of the tension roller wherein the catching female part and the male part catch and fix at a region of traveling in the tension direction of the tension roller whereby the roller supporting member is easily mounted to the supporting part.

The roller supporting part is applied with a tension so that the roller supporting member can be kept being held to the supporting part by the female member's catching the male member. More specifically, it becomes possible to keep a state where the roller supporting member is mounted to the supporting part while applying a tension to the roller supporting part.

By the endless belt is tight set to the tension roller of the supporting member, unification of the units which are component parts of the belt supporting unit is possible without a connecting member with an added tension to the roller supporting member to cut a connecting member for reducing the cost.

According to yet another aspect of the invention, the image forming apparatus comprises a cleaning mechanism having a cleaning member which cleans paper powder or toner pressed and remaining on the surface of the circumference of the endless belt wherein a rotational shaft part of the cleaning mechanism is detachably and rotatably attached to the supporting frame and a frame of the cleaning mechanism is turned with the rotation of the rotational shaft part so that the frame of the cleaning mechanism faces the belt supporting frame, fixing the both frames at a point where the cleaning member presses the surface of the circumference of the endless belt.

Thus, since the cleaning mechanism has the rotational shaft part which is detachably and rotatably attached to the supporting frame, it is possible to be attached and detached to and from the belt supporting frame without screws or others.

As the rotational shaft part of the cleaning mechanism is detachably and rotatably attached to the supporting frame and the frame of the cleaning mechanism is turned with the rotation of the rotational shaft part so that the frame of the cleaning mechanism faces the belt supporting frame, fixing the both frames at the point where the cleaning member presses the surface of the circumference of the endless belt, a first action by which the rotational shaft part of the cleaning mechanism is attached to the belt supporting frame and a second action by which the cleaning frame is turned by a predetermined angle enable the cleaning member to be easily mounted to the position of the supporting frame where the belt supporting frame presses the surface of the circumference of the endless belt.

According to another effective embodiment of the present invention, a cleaning frame is capable of turning parallel in the vicinity of or in contact with a wall of the belt supporting frame while a catching member is provided on one frame face of the both frames, the catching member being capable of deforming elastically and catching holes provided on the other frame at a position corresponding to the position of pressing the endless belt of the cleaning member.

According to the embodiment, the cleaning frame is capable of turning parallel in contact with or otherwise in the vicinity of a wall of the belt supporting frame. A catching member capable of deforming elastically is provided on one frame face of the both frames and further holes are provided on the other frame. The catching member capable of deforming elastically catches the holes provided on the other frame at a position corresponding to the position of pressing the endless belt of the cleaning member. Thus, the cleaning member is easily mounted to a position of the belt frame where the cleaning frame is pressed to the surface of the circumference of the endless belt.

It is preferable that the holes which catch rotatably the rotational shaft part of the cleaning mechanism, i.e. the holes which catch detachably and rotatably the rotational shaft part of the cleaning mechanism to the belt supporting frame, are provided as a circular hole and an arc opening, the arc having less than half circle and are positioned so that a supporting face of the arc opening is opposed to a circumference surface pressing direction of the endless belt of the cleaning member.

In this way, as the catching holes which catch the rotational shaft part of the cleaning mechanism are formed as a circular hole and a arc hole, the arc having less than half circle, when a half circular holding opening is provided on one side of the frames of the belt supporting unit lateral face and a circular holding opening is provided on the other side of the frames, the other end of the rotational shaft part can be inserted to the circular holding opening on the other side of the frames and one end of the rotational shaft is inserted to the half circular holding opening on the one side of the frames from an opening side of the half circle so that it is unnecessary to be provided a pair of holding openings having elastic members for widening the openings to insert.

It is preferable that the rotational shaft part of the circular hole side is constructed in such a manner that it is capable of connecting a driving system which drives a screw provided in the cleaning mechanism to discharge residual toner. In this way, a driving force is easily and reliably communicated to the screw by connecting the driving system which drives the screw discharging residual toner coaxially with the rotational shaft part.

According to yet another effective embodiment of the present invention, an elastic force imparting device is provided to a shutter mechanism which opens and closes a discharge opening of waste toner on a side of a cleaning frame of the cleaning mechanism so as to keep an opening state of the shutter mechanism by pressing the elastic force imparting device to impart an elastic force with the apparatus itself or one of members that the apparatus itself has. In this regard, it is preferable that an opening position of the shutter is set by pressing the elastic force imparting device to impart an elastic force with the apparatus itself or one of members that the apparatus itself has and a closing of the shutter is possible to close the shutter by departing the apparatus itself or one of members that the apparatus itself has from the belt supporting unit while an elastic force imparted through the elastic force imparting device of the cleaning member is cancelled by closing the shutter.

According to the embodiment, an inner part of the apparatus is not contaminated with scattered toner since the shutter mechanism with the elastic force imparting device to open and close the discharge opening for waste toner is provided on the cleaning frame and an opening state of the shutter mechanism can be maintained by pressing the elastic force imparting device with the apparatus itself or one of members that the apparatus has by mounting the belt supporting unit at the mounting position of the apparatus itself when the belt supporting unit having the cleaning mechanism is mounted to and detached from the apparatus itself side and the discharge opening for waste toner can be closed by canceling the pressure of the apparatus itself or one of the members that the apparatus itself has when the belt unit is dismounted.

According to yet another aspect of the invention, an image forming apparatus comprises an image bearing body which forms an image by an electro-photographic method, an intermediate transfer belt which is rotated by a driving roller and transfers primarily the image on the image bearing body and a mechanism for secondarily transferring the image on the intermediate transfer belt to a final transfer member wherein the intermediate transfer belt has a plurality of layers of two layers or more, and when a percentage difference of a stretched length of an outer circumference of the intermediate transfer belt to an inner circumference thereof at a position of contact to the driving roller is A % and a percent difference of a length of stretched side of the belt driven and stretched by the driving roller to a length of non-stretched opposite side of the belt is B %, a relation $3<A<7$ and $3<A+B<10$ are obtained.

In this way, even if a small diameter driven roller of a large curvature is used for driving the intermediate transfer belt, as a percentage difference of a stretched length of an outer circumference of the intermediate transfer belt to an inner circumference thereof at a position of contact to the driving roller "A" falls into the inequality $3<A<7$, the intermediate transfer belt can bear elongation which absorb a distortion at a maximum curvature of the driving roller so as to keep durability and prevent color drift and an image without midsection when transferring.

Since a percent difference of a length of stretched side of the belt driven and stretched by the driving roller to a length of non-stretched opposite side of the belt "B" falls into the inequality $3<A+B<10$, an impact by the driving roller when driving is absorbed by a small elongation of the intermediate transfer belt so as to prevent dilatation and crack. As a result, a compact image forming apparatus having an intermediate transfer belt which gives a stable image quality for a long time without color drift.

A base material layer of the intermediate transfer belt is made so that the base material layer has a thickness of 50 μm or more and 150 μm or less and a percent difference of a length of the base material layer of stretched side of the belt driven and stretched by the driving roller to a length of the base material layer of non-stretched opposite side of the belt is 1-10%.

By thus making the base material layer of the intermediate transfer belt, the belt can keep such strength that a rotational energy from the driving roller is accurately transmitted to the whole intermediate transfer belt. Also, it is possible to offer a compact forming apparatus having an intermediate transfer belt which give a stable image quality for a long time without color drift since a percent difference of a length of streched side of the belt driven and stretched by the driving roller to a length of non-stretched opposite side of the belt "B" falls into the inequality $3<A+B<10$.

Further, an elastic material layer which compose the intermediate transfer belt is made so that the thickness of the elastic material layer is 300 μm or more and 700 μm or less and a percent difference of a length of the elastic material layer of stretched side of the belt driven and stretched by the driving roller to a length of the elastic material layer of non-stretched opposite side of the belt is 2-10%.

A thickness and elongation of the elastic material layer of the intermediate transfer belt are particularly important to control formation of a transfer nip, color drift or an image without midsection. With such thickness and elongation, the transfer nip can be taken with the image bearing body so that stable transportation is possible as an intermediate transfer belt. As a result, a compact image forming apparatus having an intermediate transfer belt which enable a quality stable image can be provided.

It is preferable for a surface layer of the intermediate transfer belt to contain fluorocarbon resin. Thus, because an outermost surface comprises a releasing material layer, images can be transmitted to the surface of the image bearing body without damaging resilience of the underlain elastic material layer so as to be able to obtain enough transferring and releasing effect and stable durability. As a result, a compact image forming apparatus having an intermediate transfer belt which enable a quality stable image can be provided.

Further, it is preferable that the driving roller is made of metal and has a diameter of 25 mm or less, the surface of which is treated with ceramic particles which do not perform plastic deformation to obtain a surface roughness of Rz=1-15 μm.

With thus composed driving roller, stable driving of the intermediate transfer belt can be materialized without giving the intermediate transfer belt a big distortion, without enlarging the apparatus itself and further without generating a drawback of leaving concavity and convexity on the surface of the intermediate transfer belt which communicate the driving force.

BRIEF DESCRIPTION OF THE DRAWINGS

FIG. 20 is a table providing data for a variation of components of an intermediate transfer belt in accordance with embodiments of the present invention.

DETAILED DESCRIPTION OF THE PREFERRED EMBODIMENT

The invention will now be described below in detail by way of example with reference to the accompanying drawings. It should be understood, however, that the description herein of specific embodiments such as to the dimensions, the kinds of material, the configurations and the relative disposals of the elemental parts and the like is not intended to limit the invention to the particular forms disclosed but the intention is to disclose for the sake of example unless otherwise specifically described.

Figure 1:
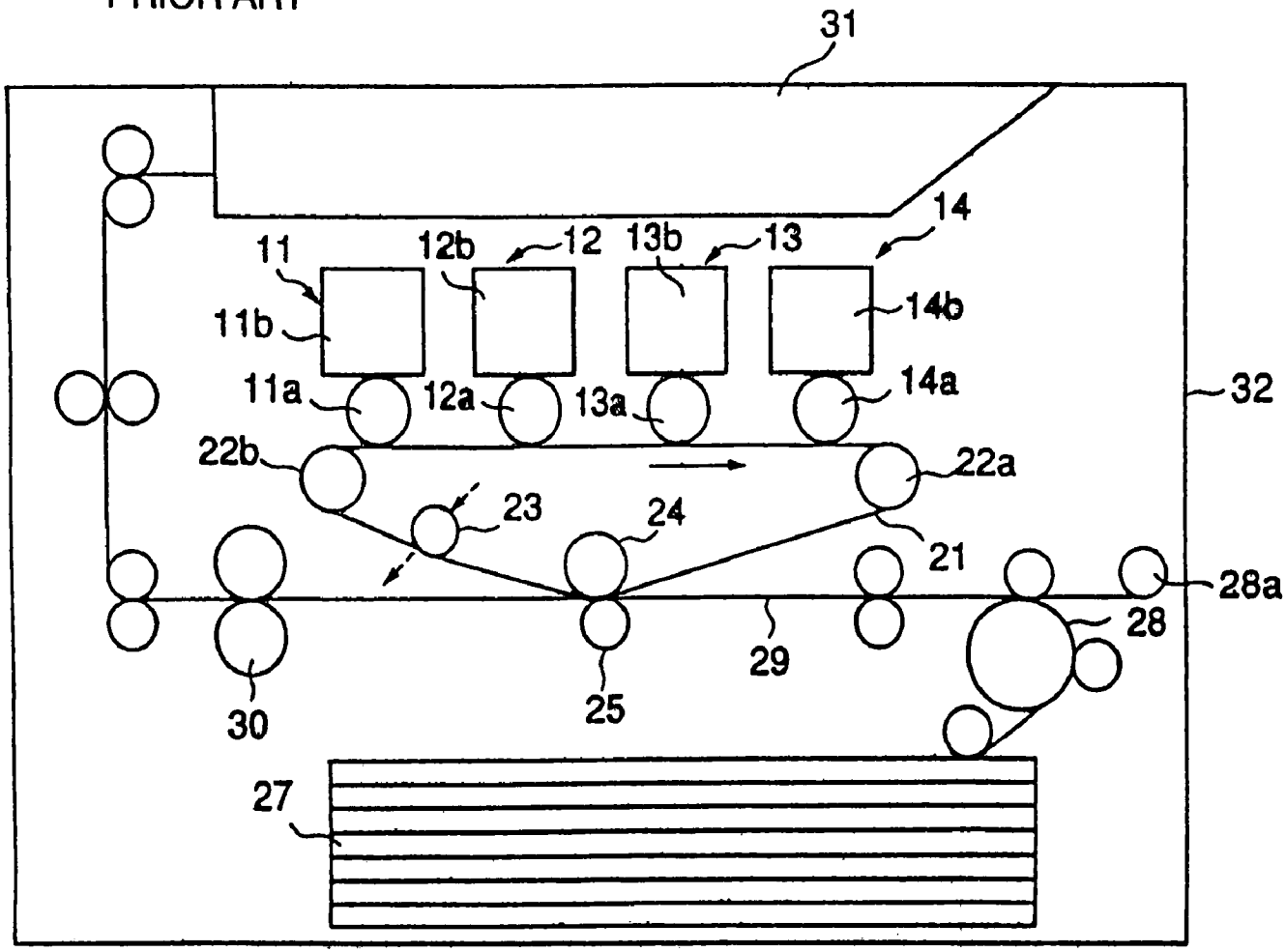
Fig.1 PRIOR ART
FIG. 1 is an illustrative schematic drawing of a conventional image forming apparatus.
Figure 2:
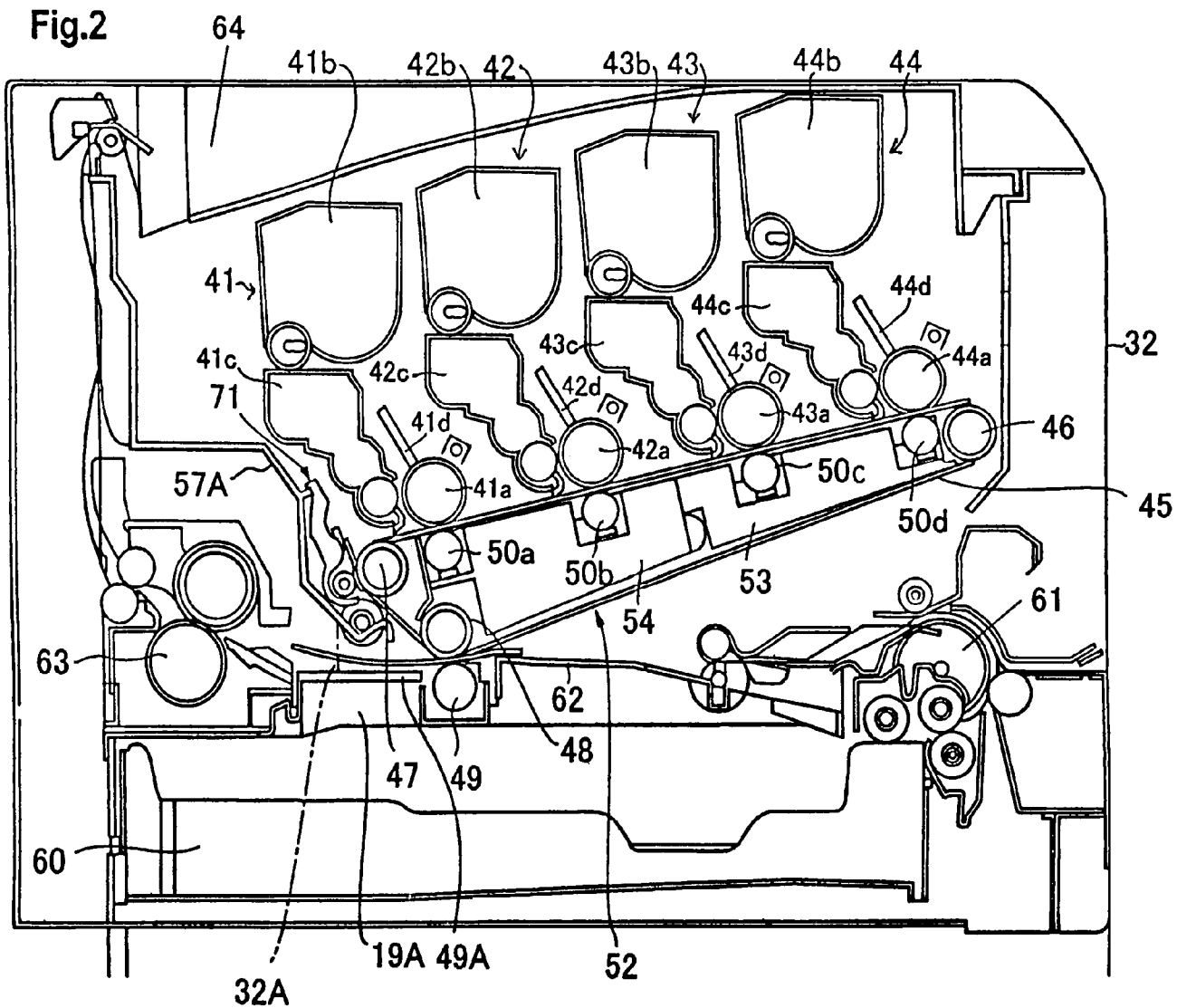
FIG. 2 is an illustrative schematic drawing of an image forming apparatus in accordance with an embodiment of the present invention.
Figure 3:
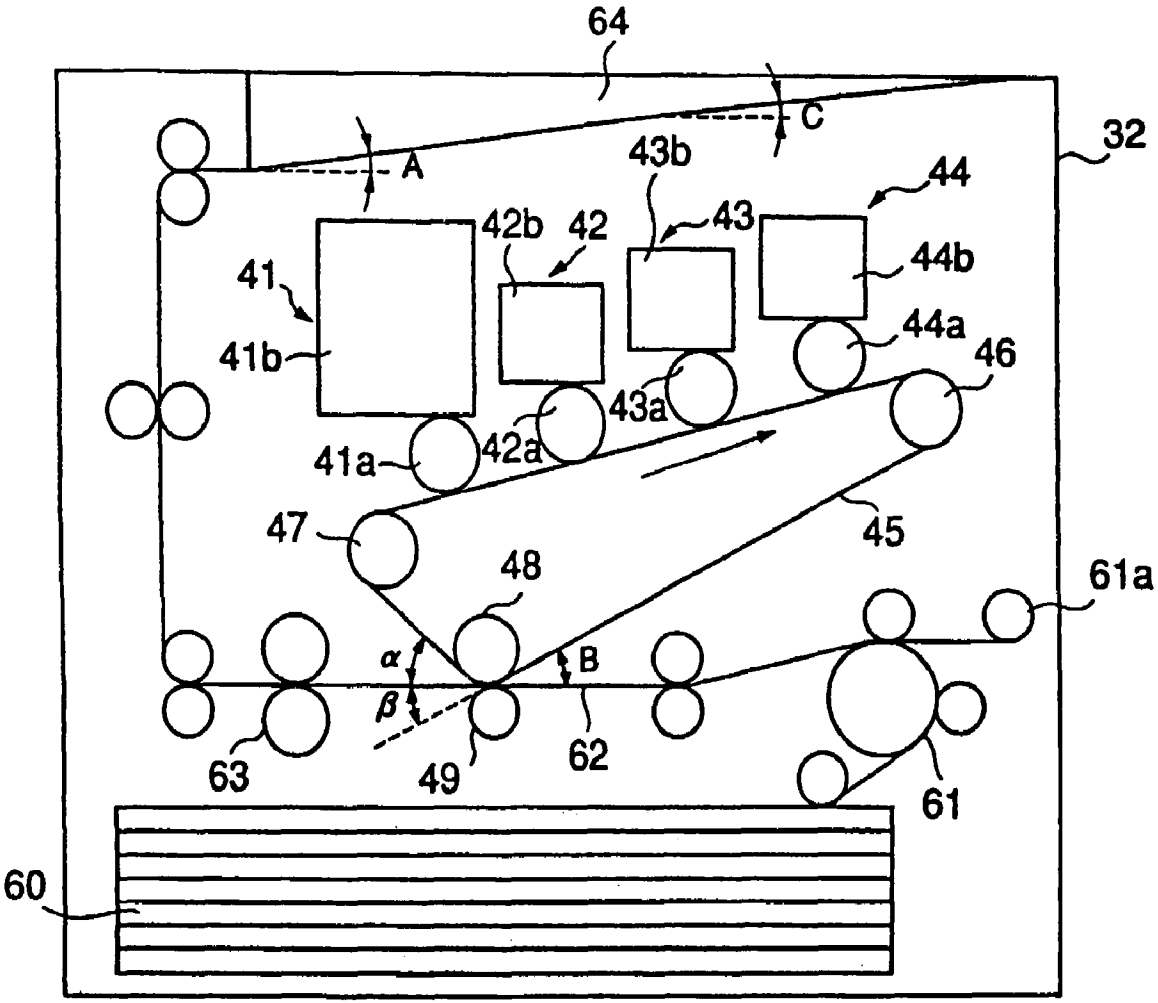
FIG. 3 is a more generalized illustrative schematic drawing of the image forming apparatus of FIG. 2.

The image forming apparatus shown in FIGS. 2 and 3 consists of a plurality of image forming units 41-44. Image forming units 41-44 are composed of photosensitive body drums (image bearing bodies) 41*a*-44*a*, developing devices 41*c*-44*c* (not shown in FIG. 3) and exposing units 41*d*-44*d* (not shown in FIG. 3), respectively. Toner containers 41*b*-

44*b* are also provided, respectively, for image forming units 41-44. Image forming units 41-44 may have a handle (not shown) for allowing image forming units 41-44 to be turned at a predetermined angle in order to remove photosensitive body drums 41*a*-44*a* from intermediate transfer belt 45 and withdrawing image forming units 41-44.

Image forming units 41, 42, 43 and 44 correspond to black, yellow, magenta and cyan, respectively. Image forming units 41-44 and photosensitive body drums 41*a*-44*a* are disposed along the transporting direction of intermediate transfer belt 45. Photosensitive body drum 41*a* is disposed at the most upstream point and photosensitive body drum 44*a* is disposed at the most downstream point.

Intermediate transfer belt 45 is supported by a driving roller (a first roller) 46, a supporting roller (a second roller) 47 and a backup roller (a third roller) 48. Driving roller 46 drives intermediate transfer belt 45 in the direction shown by the solid arrow headed line in FIG. 3 and is tensed, as is described later, with a predetermined tension by supporting roller 47. Backup roller 48 is disposed so as to face a secondary transfer roller 49. A primary transfer part is defined between driving roller 46 and supporting roller 47. Image forming units 41, 42, 43 and 44 are disposed along the primary transfer part.

A cleaning device 71, shown in FIG. 2, is provided for cleaning residual toner (i.e., waste toner) on intermediate transfer belt 45. A heat insulating wall 57A is provided to the left side of cleaning device 71 in order to intercept heat generated from fixing device 63. Insulating wall 57A prevents heat from reaching intermediate transfer belt 45, a belt supporting frame 51 (shown in FIG. 4) and developing devices 41*c*-44*c*. Cleaning device 71 is disposed in contact with heat insulating wall 57A so as not to be affected by heat created by fixing device 63. Such a design allows for a shortened distance between fixing device 63 and secondary transfer roller 49 and intermediate transfer belt 45. This allows for construction of a more compact image forming apparatus.

A waste toner container 19A, of FIG. 2, is disposed under cleaning device 71 through a waste toner wall 49A. Waste toner piping 32A extends from waste toner wall 49A to an area under a waste toner discharging port (not shown) of cleaning device 71.

Intermediate transfer belt 45 is slanted from the left side to the right side at the primary transfer part, as shown in FIGS. 2 and 3. That is, intermediate transfer belt 45 is upwardly slanted toward the direction of photosensitive body drum 44*a* from photosensitive body drum 41*a*. Backup roller 48 is disposed vertically under photosensitive body drum 41*a* and at close hand to driving roller 46.

Figure 4:
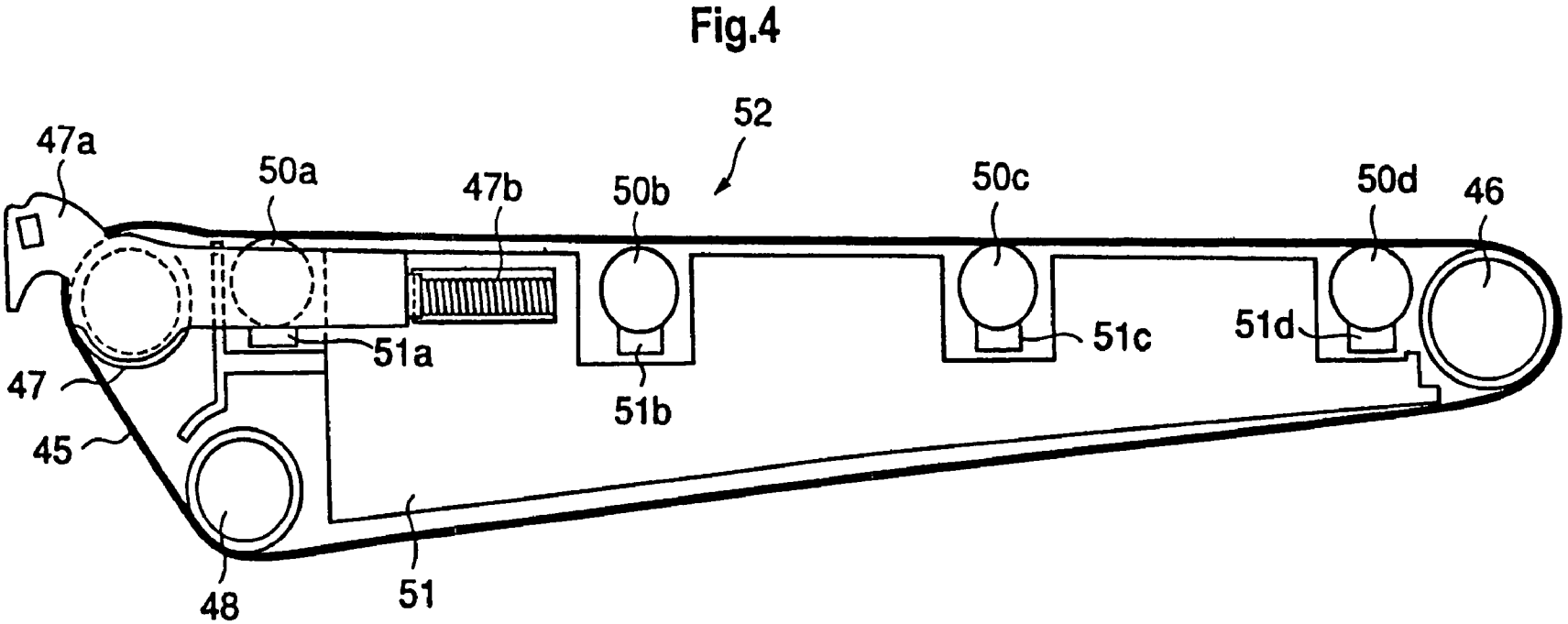
FIG. 4 is an illustrative schematic drawing of an intermediate transfer belt unit of the image forming apparatus of FIG. 3.

In FIG. 4, intermediate transfer belt unit 52 has driving roller 46, supporting roller 47, backup roller 48 and primary transfer rollers 50*a*-50*d*, all of which are connected to supporting frame 51. Intermediate transfer belt unit 52 also has supporting roller holding member 47*a* which holds supporting roller 47. Supporting roller holding member 47*a* is capable of moving in the traveling direction of intermediate transfer belt 45 on belt supporting frame 51. Supporting roller holding member 47*a* is pressed by a spring (pressing member) 47*b* so that supporting roller 47 may apply tension to intermediate transfer belt 45, tensing intermediate transfer belt 45. Primary transfer rollers 50*a*-50*d* are pressed in the direction of photosensitive body rollers 41*a*-44*a* (FIG. 2) by springs 51*a*-51*d*.

Referring to FIGS. 3 and 4, when an image is formed on a recording medium, a toner image is formed on photosensitive body drums 41*a*-44*a* synchronized with the moving of intermediate transfer belt 45. The toner image is sequentially transferred primarily on intermediate transfer belt 45 to form a primary transfer image. The recording medium is transported to a secondary transporting position by a paper reversing roller 61 from a paper supplying unit 60 on recording medium transporting belt 62. The recording medium becomes sandwiched between backup roller 48 and secondary transfer roller 49 together with intermediate transfer belt 45. The toner image is transferred secondarily onto the recording medium by secondary transfer roller 49. The recording medium is then sent to fixing device 63 where the image is fixed and discharged to discharge tray 64. A recording medium may be manually inserted on recording medium transporting belt 62 using manual insertion roller 61*a*.

An additional roller is not necessary in the image forming apparatus of FIG. 3 since supporting roller 47, shown in FIGS. 2, 3 and 4, applies tension to intermediate transfer belt 45. Moreover, since a primary transfer is made by first primary transfer roller 50*a* after tension has been applied, intermediate transfer belt 45 becomes difficult to distort so that stretching of intermediate transfer belt 45 is uniform.

Intermediate transfer belt 45 is sloped upwardly in the direction of photosensitive body drum 44*a* from photosensitive body drum 41*a* at the primary transfer side so that the secondary transfer position is vertically under photosensitive body drum 41*a* (i.e., primary transfer roller 50*a*). As shown in FIG. 4, backup roller 48 is disposed vertically under primary transfer roller 50*a*. Due to the vertical placement of backup roller 48, an elastic force exerted by spring 51*a* may only impart a force on backup roller 48 in the vertical direction. Therefore, the secondary transfer position, is not considerably affected by the vertical elastic force imparted by spring 51*a*.

Allowing image forming unit 41, at the most upper stream side of the image forming apparatus (see FIG. 3), to be for black (K) toner (having a lower melting point than the other colors), provides for excellent toner transfer. As a result of intermediate transfer belt 45 being in a sloped position, as described above, more space is created in the upper left hand side of the image forming apparatus of FIG. 3. The larger space allows for integration of a larger toner container 41*b*. This in turn allows for more storage of black toner, which is more frequently consumed than other colors.

The transporting pathway to fixing device 63 can be defined within a range of $\alpha+\beta$. The angle $\alpha$ is an angle between intermediate transfer belt 45 (measured from the point between backup roller 48 and supporting roller 47) and the paper transporting pathway. The angle $\beta$ is an angle between an extended line of intermediate transfer belt 45 (at the point between the driving roller 46 and the backup roller 48) and the paper transporting pathway. Intermediate transfer belt 45 being disposed in such angles allows for fixing device 63, and indeed the image forming apparatus as a whole, to be flexible in design. The distance between the secondary transferring position and fixing device 63 may be shortened, resulting in a reduction of size in the image forming apparatus. Furthermore, because backup roller 48 is disposed close to supporting roller 47 and vertically under primary transfer roller 50*a*, the angle between intermediate transfer belt 45 and recording media transporting belt 62 is made large. This larger angle allows the recording medium to be easily separated from intermediate transfer belt 45.

It is preferable that the gradient angle of intermediate transfer belt 45 be restricted so as to satisfy the equation $(A+C)/2\sim3=B$ or the inequality $A>B+5°\sim10°$, where A is an angle of the first half of an upper paper discharge part, B is an angle of intermediate transfer belt 45 and C is an angle of the last half of the upper paper discharge part as shown in FIG. 3. When the gradient angle of intermediate transfer belt 45 is restricted in the manner described, image forming units 41-44 of FIGS. 2 and 3 may be disposed suitably in a space between an upper cover and the intermediate transfer unit. The restricted gradient angle of intermediate transfer belt 45 also helps to create space in the bottom right-hand corner of the image forming apparatus for housing paper reversing roller 61 and manual insertion roller 61*a*, while still contributing to the reduction in size of the image forming apparatus as a whole.

Figure 5:
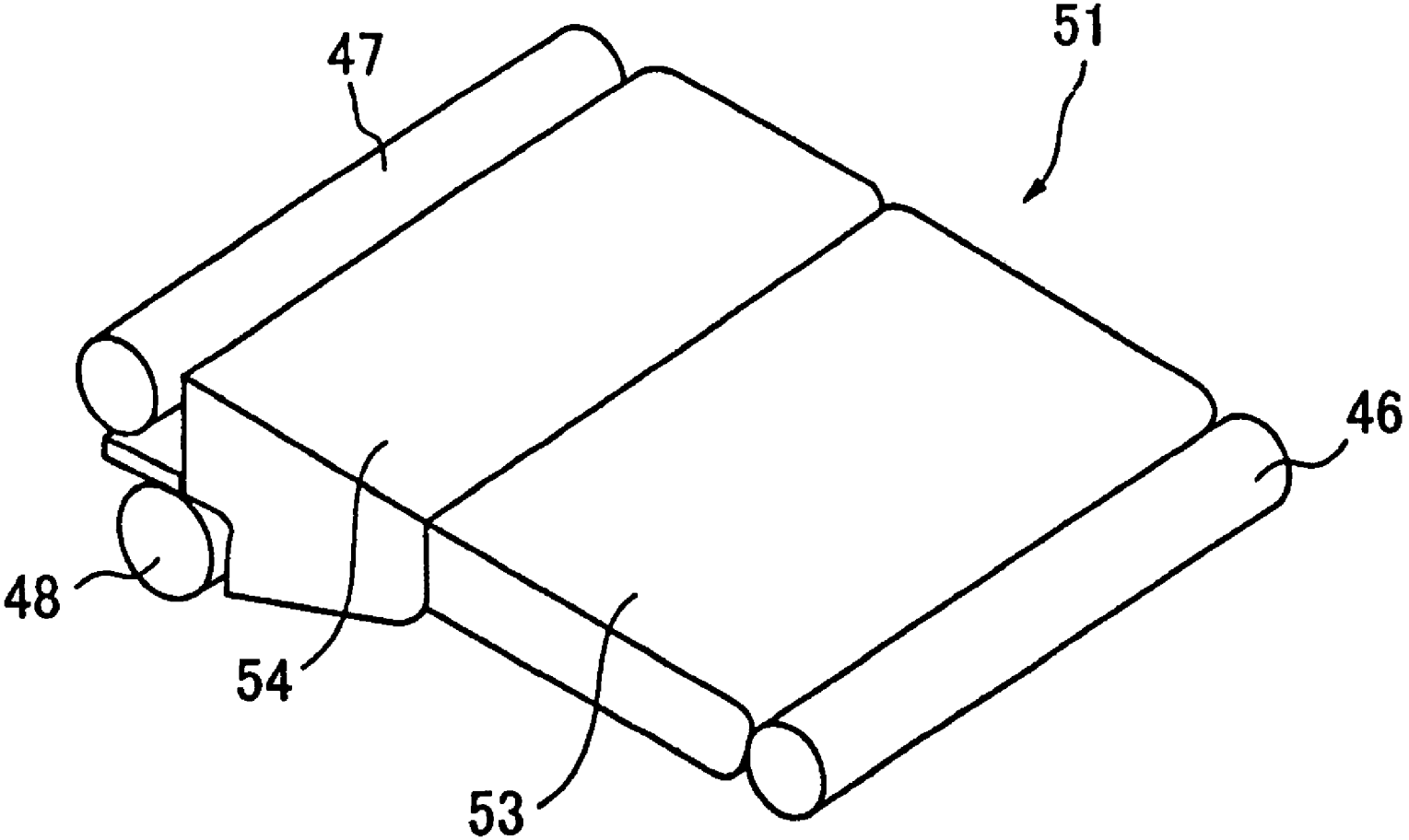
FIG. 5 is a perspective drawing illustrating a belt supporting frame in accordance with an embodiment of the present invention.
Figure 6:
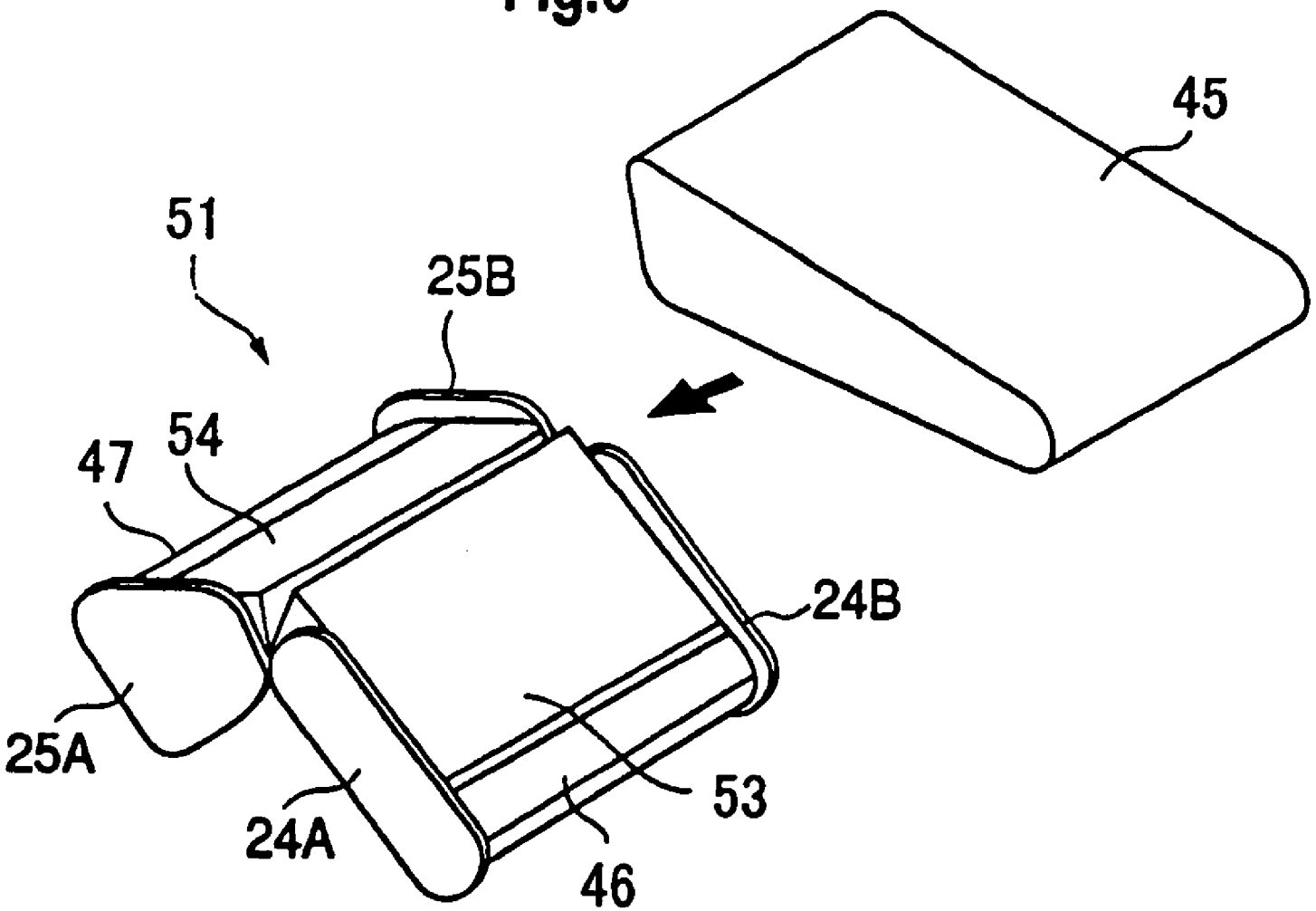
FIG. 6 is a perspective drawing illustrating mounting of an endless belt in accordance with an embodiment of the present invention.

Another embodiment of an intermediate transfer belt unit 52 of FIG. 4 is described as follows. In FIGS. 5 and 6, an intermediate transfer belt supporting frame 51 of transfer belt unit 52 (FIG. 4) has unit bodies 53 and 54, a driving roller 46, a supporting roller 47 and a backup roller 48. Guide members (i.e., protective covers) 24A, 24B, 25A and 25B of FIG. 6 are provided at the lateral sides of belt supporting frame 51. Unit bodies 53 and 54 of belt supporting frame 51 may be horizontally stretched into a fixed position, as shown in FIG. 5, and may permit bending, as shown in FIG. 6.

Figure 7:
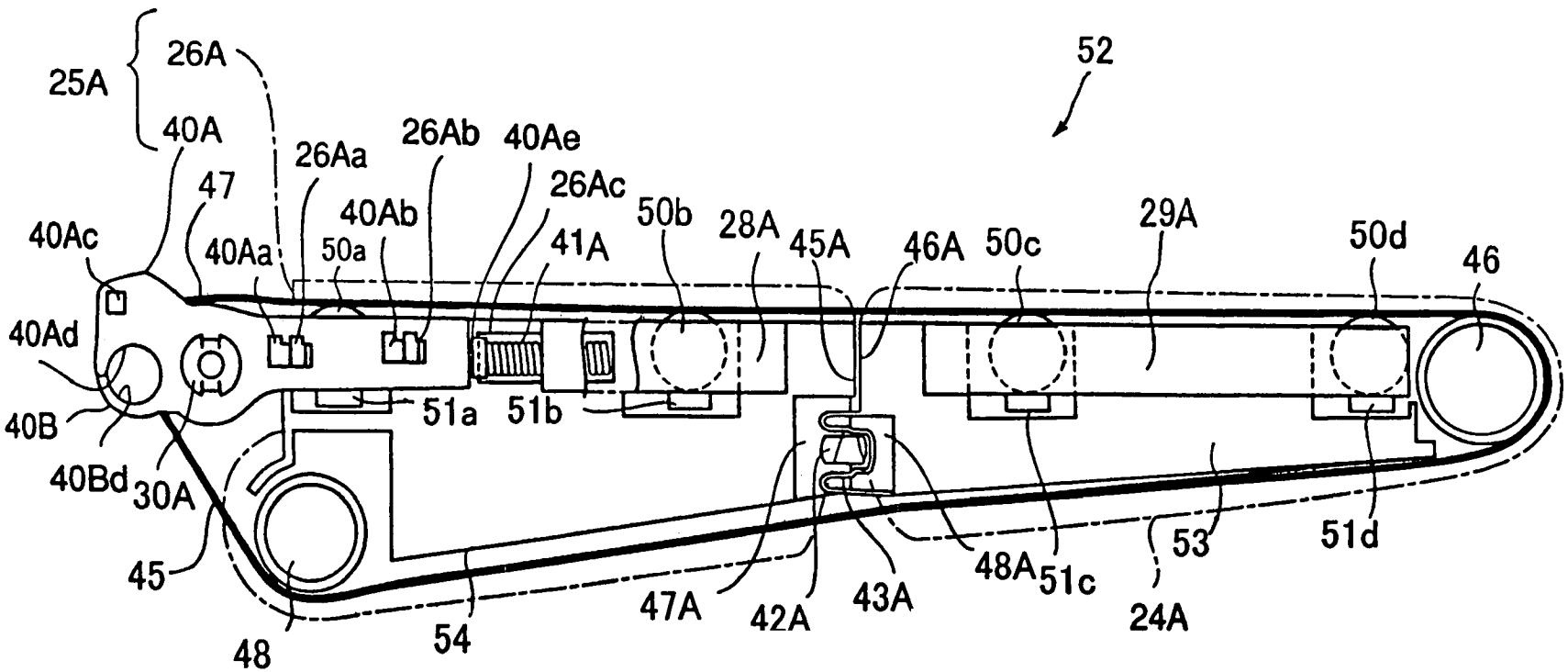
FIG. 7 is an illustrative schematic drawing of a belt supporting frame for an intermediate transfer belt in accordance with an embodiment of the present invention.

In FIG. 7, unit body 54 houses primary transfer rollers 50*a* and 50*b*. Guide members 25A and 25B are attached on the lateral sides of unit body 54, as shown in FIG. 6. A holding member 40A for supporting roller 47 comprises guide members 26A and 25A, represented by dashed lines in FIG. 7. Holding member 40A for supporting roller 47 has a bearing 30A, openings 40Aa and 40Ab, a hole 40Ac (for positioning a cleaning device described later), a half circular hole 40Ad and a contact part 40Ae. Protrusions 26Aa and 26Ab are provided on the lateral side of guide member 26A. Protrusions 26Aa and 26Ab are inserted into openings 40Aa and 40Ab, respectively, of holding member 40A allowing contact part 40Ae to make contact with spring 41A. Spring 41A is disposed at recessed part 26Ac. Holding member 40A is pressed towards the left by spring 41A through contact part 40Ae, whereby guide member 26A is attached by holding pressure towards the left. Protective cover 28A is attached to guide member 26A by providing protrusions (not shown) on the outer lateral side of guide member 26A. The protrusions may fit into the openings (not shown) of protective cover 28A. Protective cover 28A may be attached to guide member 26A in a manner similar to attaching holding member 40A to guide member 26A.

Guide member 26B (not shown), of the same size and functionality as guide member 26A, is disposed on the back side of the drawing provided in FIG. 7. An opening is provided on the lateral side of guide member 26B, similar to guide member 26A, where spring 41A is disposed. Holding member 40B for supporting roller 47 is provided on the lateral side opposite the lateral side of unit body 54 where guide member 40A is provided. A whole circular hole is provided coaxially with a half circular opening 40Ad of the front side holding member 40A as an opening of holding member 40B for supporting roller 47. Attaching holding member 40B and protective cover 28A to guide member 26B is performed in the same manner described for attaching holding member 40A and protective cover 28A to guide member 26A. Holding member 40B may be attached to guide member 26B by allowing spring 41A to apply force in the left direction against contact part 40Ae.

Unit body 53 of FIG. 7 houses primary transfer rollers 50*c* and 50*d*. Guide members 24A and 24B are attached to the lateral sides of unit body 53, as shown in FIG. 6. Similar to the attachment of holding member 40A to guide member 26A, protective cover 29A is attached to guide member 24A by providing protrusions (not shown) on the lateral side of guide member 24A to slip into openings (not shown) provided on protective cover 29A. Guide member 24B, having the same outside dimension as guide member 24A, is disposed on the lateral side opposite the lateral side guide member 24A is disposed. Guide member 24B also has protective cover 29A.

In FIG. 7, supporting point 42A is provided on unit body 54 to allow for bending between unit bodies 54 and 53. Receiving part 43A is provided on unit body 53 for receiving supporting point 42A when unit bodies 54 and 53 are bent into their horizontal stretched position, as shown in FIG. 5. The supporting face of receiving part 43A is rounded so as to allow supporting point 42A to become embedded into the grooved part of receiving part 43A when turning unit bodies 53 and 54 in the direction positioning them in the horizontal stretched position.

Figure 8:
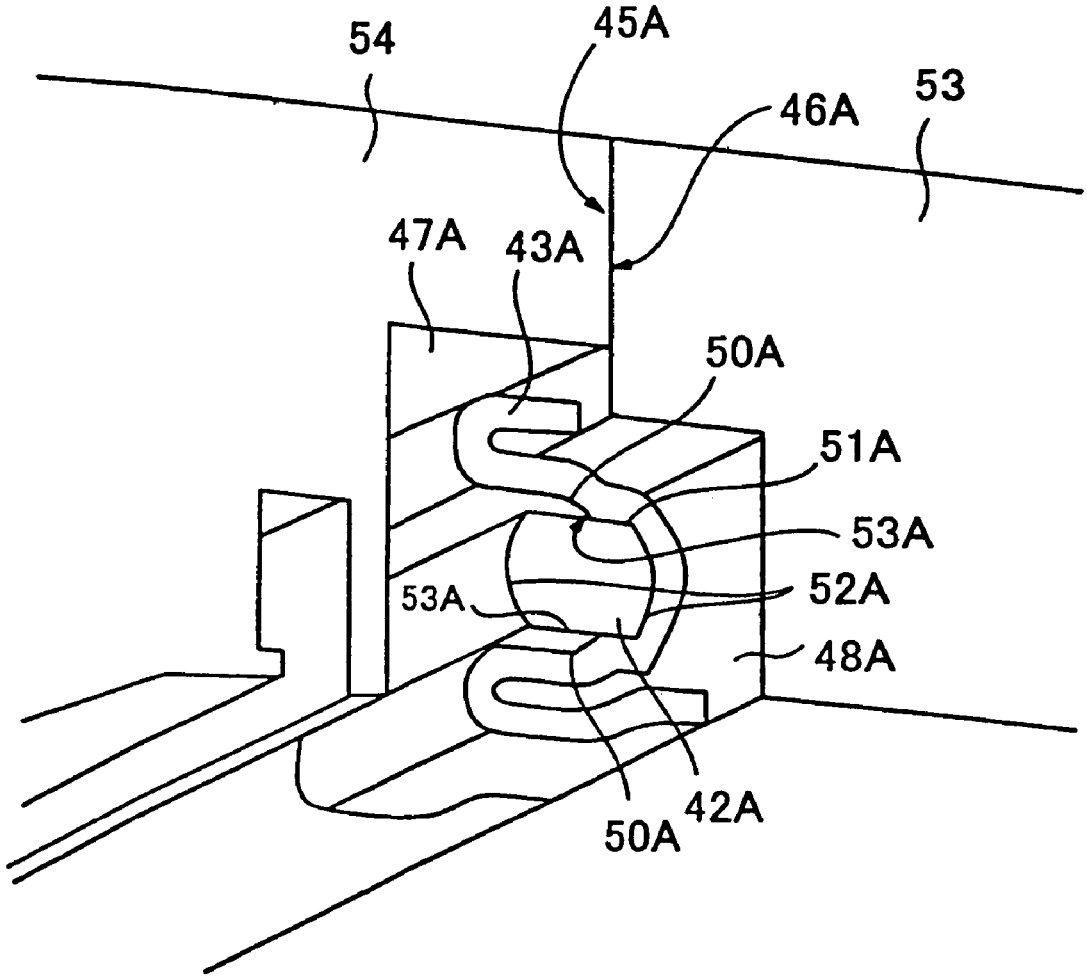
FIG. 8 is an enlarged drawing illustrating a supporting part of the belt supporting frame of FIG. 7.

As shown in FIG. 8, receiving part 43A of unit body 53 receives supporting point 42A of unit body 54 when unit bodies 54 and 53 are bent together to form their stretched horizontal position, as shown in FIG. 5. Round part 50A of receiving part 43A receives supporting point 42A when it is being turned into the direction of receiving part 43A. Groove part 51A allows supporting point 42A to be embedded in receiving part 43A after it has completed its travel along round part 50A. Supporting point 42A is shaped with round parts 52A and flat parts 53A. Round parts 52A of supporting point 42A have approximately the same curvature as round part 50A of receiving part 43A. Flat parts 53A of supporting point 42A are embedded to groove parts 51A. Supporting point 42A and receiving part 43A are disposed to recessed parts 47A and 48A provided on unit bodies 54 and 53, respectively. Both sides of the longitudinal direction of supporting point 42A are fixed to the holding member provided (not shown) on unit body 54.

A method for mounting intermediate transfer belt 45 to belt unit 52 is described using FIG. 7. As already described, belt unit 52 is composed so as to be capable of separating into two separate unit bodies 53 and 54, in a direction perpendicular to the transporting direction of intermediate transfer belt 45.

As shown in FIG. 7, unit body 53 includes driving roller 46, primary transfer rollers 50*c* and 50*d*, springs 51*c* and 51*d*, and receiving part 43A. Driving roller 46 drives intermediate transfer belt 45. Springs 51*c* and 51*d* press against primary transfer rollers 50*c* and 50*d*, respectively, so as to allow intermediate transfer belt 45 to make contact with corresponding photosensitive body drums 43*a* and 44*a*. Receiving part 43A is responsible for receiving supporting point 42A of unit body 54 in order to allow unit bodies 53 and 54 to bend into a fixed horizontal position, as shown in FIG. 5.

Unit body 54 includes supporting roller 47, backup roller 48, primary transfer rollers 50*a* and 50*b*, springs 51*a* and 51*b*, holding member 40A and supporting point 42A. Springs 51*a* and 51*b* press against primary transfer rollers 50*a* and 50*b*, respectively, so as to allow intermediate transfer belt 45 to make contact with corresponding photosensitive body drums 41*a* and 42*a*. Holding member 40A is capable of moving in the running direction of intermediate transfer belt 45 and supports supporting roller 47. Supporting point 42A fits into receiving part 43A of unit body 53 in order to allow unit bodies 53 and 54 to bend into a fixed horizontal position, as shown in FIG. 5.

Belt unit 52 has backup roller 48 for supporting the belt facing secondary transfer roller 49 (FIG. 3) at the ends of guide members 26A and 26B so as to allow bending of belt frame 51 at the vicinity of its center whereby a whole outer circumference of belt supporting frame 51 becomes shorter than an inner circumference of intermediate transfer belt 45.

First primary roller 50*a*, which is primarily responsible for transferring an image, is disposed to the right of supporting roller 47. The positioning of first primary roller 50*a* allows an image to initially be transferred with a uniform pressure at the position where strong tension is generated, avoiding strain and diagonal traveling.

Unit bodies 53 and 54 have vertical planes 45A and 46A, respectively, at the belt side of the upper part of supporting point 42A, as shown in FIG. 8. When flat part 53A of supporting point 42A is embedded into groove part 51A of receiving part 43A, vertical planes 45A and 46A contact each other. Unit bodies 53 and 54 are unified firmly by strict positioning when supporting point 42A is embedded into groove part 51A of receiving part 43A.

Figure 9A:
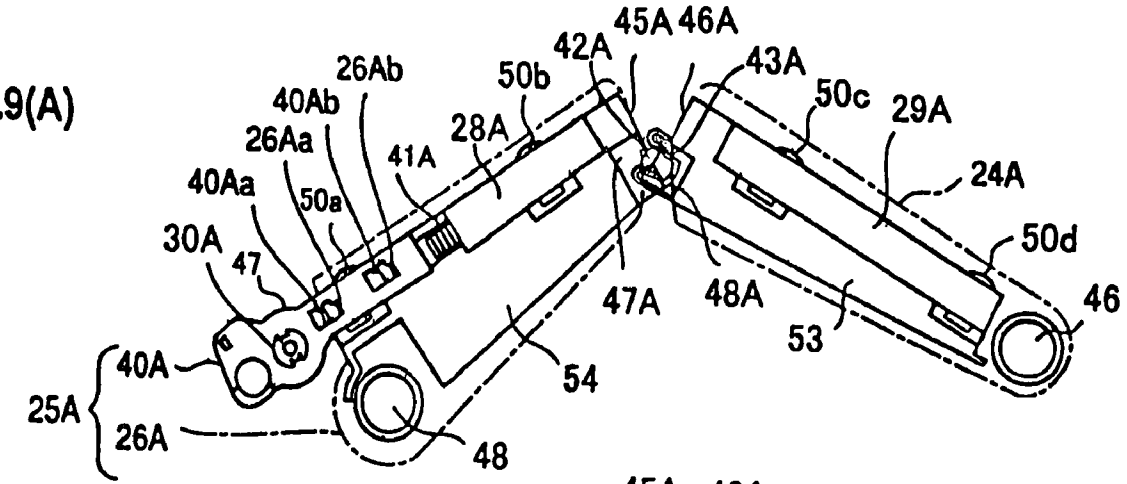
FIGS. 9(A) and 9(B) are illustrative schematic drawings of a belt supporting frame in a bending transition in accordance with an embodiment of the present invention.

When unit bodies 53 and 54 are bent apart as shown in FIG. 9(A), supporting point 42A, located at the valley side of bending, detaches from groove part 51A of receiving part 43A. Round part 52A of supporting point 42A is then caught by round part 50A of receiving part 43A to allow bending and turning of unit bodies 53 and 54. Thus, unit bodies 53 and 54 can be bent smoothly without becoming detached from one another. The bending angle of unit bodies 53 and 54 is defined by the angle created just before supporting point 42A detaches from round part 50A of receiving part 43A.

Figure 9B:
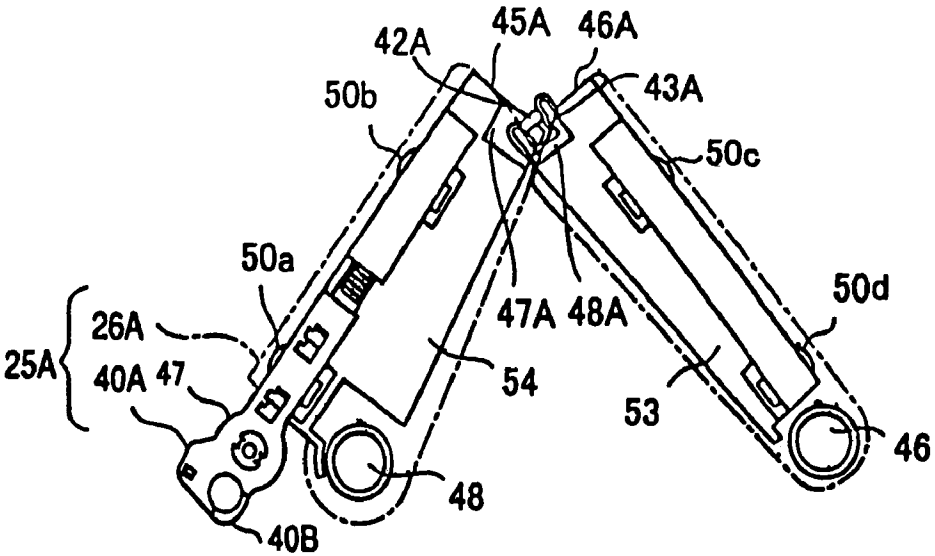

Hence, unit bodies 53 and 54 may be bent in order to permit intermediate transfer belt 45 to be mounted. Bending unit bodies 53 and 54, as shown in FIG. 9(B), allows the entire circumference of belt supporting frame 51 to become shorter than the inner circumference of intermediate transfer belt 45. Intermediate transfer belt 45 may then easily be mounted to supporting frame 51, even with guide members 24A, 24B, 25A and 25B still attached.

This eliminates the need for a cartridge having a supporting member for changing a belt, as utilized in a conventional apparatus. It no longer becomes necessary to fit the inner length of a belt with a supporting frame and tension roller by disposing the tension roller apart from the belt frame. The present invention has a design that uses a lower cost frame avoiding an additional structure required to change a belt, as well as a less complicated mechanism for mounting and replacing the belt. In addition, the present invention provides an easier method of maintenance and, more importantly, decreases the likelihood of damage to the surface of the belt. Moreover, the present invention contributes to a more compact design of the image forming apparatus.

As described thus far, the present invention utilizes holding members 40A and 40B. Holding members 40A and 40B provide support for supporting roller 47. However, holding members 40A and 40B are not fixed to only provide support but, as previously described, are also capable of moving. Movement of holding members 40A and 40B may assist supporting roller 47 in applying tension to intermediate transfer belt 45. Movement of holding members 40A and 40B are regulated by spring 41A. Contraction and extension of spring 41A regulates the movement of holding members 40A and 40B, which in turn regulate the positioning of supporting roller 47. Intermediate transfer belt 45 is stretched when tension is applied by supporting roller 47.

Allowing intermediate transfer belt 45 to be mounted to supporting frame 51 with guide members 24A, 24B, 25A and 25B still attached in place to supporting frame 51, as described above, may help to protect the edge of intermediate transfer belt 45. Thus, guide members 24A, 24B, 25A and 25B can be integrated together with supporting frame 51 in order to reduce the number of component parts associated with the image forming apparatus and fluctuation resulting from assembly. Such integration contributes to an easier recycling process of supporting frame 51. Ultimately, a more stable, higher quality, product is provided.

In FIG. 6, one side of the opening of intermediate transfer belt 45 is shaped triangularly through the use of a guide (not shown). The sustained shape of intermediate transfer belt 45 allows belt supporting frame 51 to be inserted from the other side of the opening of intermediate transfer belt 45. An endless intermediate transfer belt or an endless belt may also be opened triangularly, equilateral-triangularly or elliptically and erected on one side while supporting frame 51 is inserted from the other side of the opening.

Due to the structure of supporting frame 51 in the present invention, it is unnecessary for a tension roller to be movable like a conventional apparatus to allow the outer circumference of the surface of a belt supporting frame to be smaller than the inner circumference of a belt. In addition, it becomes unnecessary to support the belt by a supporting member when changing the belt and unnecessary to provide a cartridge for replacing the belt from the driving roller. It further becomes unnecessary to make the outer circumference of the surface of the belt supporting frame shorter than the inner circumference of the belt and dispose the tension roller apart from the belt supporting frame. As a result, an image forming apparatus having a low cost frame is provided. The low cost frame allows for easy mounting and replacing of a belt while avoiding damage to the surface of the belt. Thus the structure of this low cost frame decreases costs associated with additional structures necessary for maintenance of the belt, as well as decreases the burden placed on workers in avoiding damage to the belt's surface.

FIGS. 5 and 6 illustrate an embodiment where supporting frame 51 may be split into two unit bodies 53 and 54. However, supporting frame 51 is not restricted to only a two unit body design. In another embodiment, supporting frame 51 may be split into more than two unit bodies. A plurality of unit bodies may be integrated into supporting frame 51 so far as to allow a belt to be properly supported.

Figure 10A:
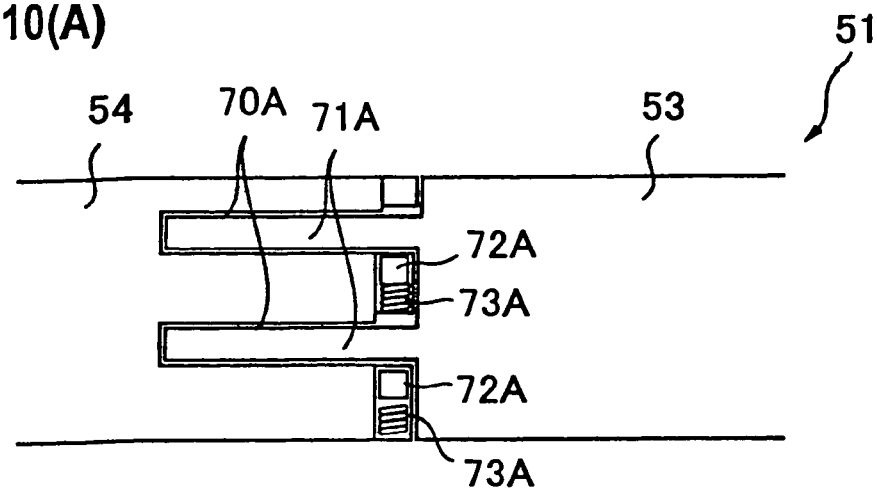
FIGS. 10(A) and 10(B) are illustrative schematic drawings of a belt supporting frame in expanding and contracting transitions in accordance with an embodiment of the present invention.
Figure 10B:
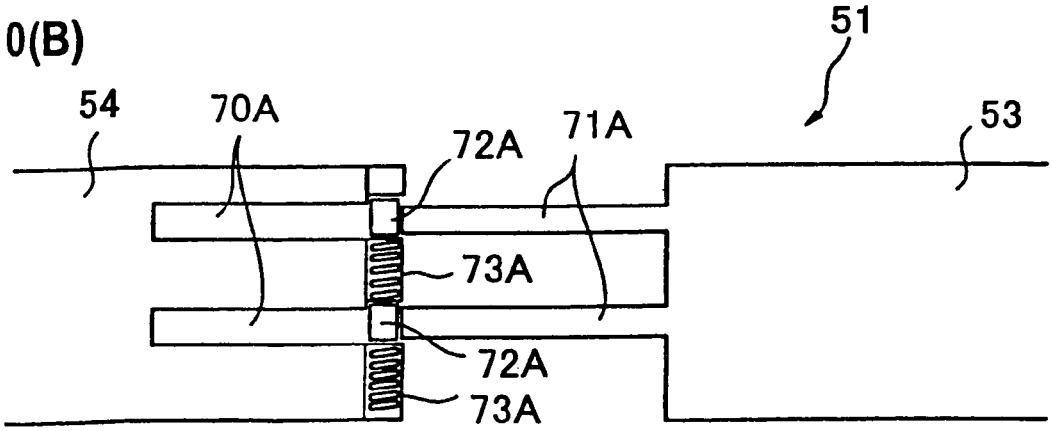

In yet another embodiment, belt supporting frame 51 may be adjusted in a way that is not exclusive to bending of a plurality of unit bodies. Belt supporting frame 51 may be capable of varying in the belt transporting direction as shown in FIGS. 10(A) and 10(B). FIGS. 10(A) and 10(B) are sectional views of belt supporting frame 51 with a variable length structure, illustrating a lateral face of the belt transporting plane edge of belt supporting frame 51.

Unit body 53 has a protruded part 71A and unit body 54 has a recessed part 70A. Recessed part 70A receives protruded part 71A. Protruded part 71A is fixed by a fixing member 72A. A spring 73A forces fixing member 72A in the upward direction at the open end side of recessed part 70A. An endless belt is mounted or removed from supporting frame 51, capable of varying in length, when protruded part 71A is fixed by fixing member 72A. As shown in FIG. 10(A), the force of spring 73A is transferred through fixing part 72A to embed protruded part 71A to recessed part 70A. The length in the belt transporting direction of belt supporting frame 51 is shortened when protruded part 71A is embedded to recessed part 70A. The endless belt may be mounted once belt supporting frame 51 is shortened. After the endless belt has been mounted, protruded part 71A is drawn from recessed part 70A. Fixing member 72A then occupies recessed part 70A to fix protruded part 71A and provide a predetermined length for belt supporting frame 51, as shown in FIG. 10(B).

Similar to bending of belt supporting frame 51 through unit bodies 53 and 54, belt supporting frame 51, with a variable length structure as described above, allows for its outer circumference to be shorter than an inner circumference of a belt. This method of installing the belt may be easily obtained without bending unit bodies 53 and 54, again avoiding costly additional mechanisms of the conventional apparatus for exchanging a belt and decreasing the likelihood of damaging the belt surface when mounting or removing the belt. This embodiment also provides an image forming apparatus having a low cost belt supporting frame. Although this embodiment is illustrated, in FIGS. 10(A) and 10(B), as a sectional view showing the lateral face in the edge direction of the belt transporting face, the structure may also be integrated as part of the belt transporting face.

Figure 11:
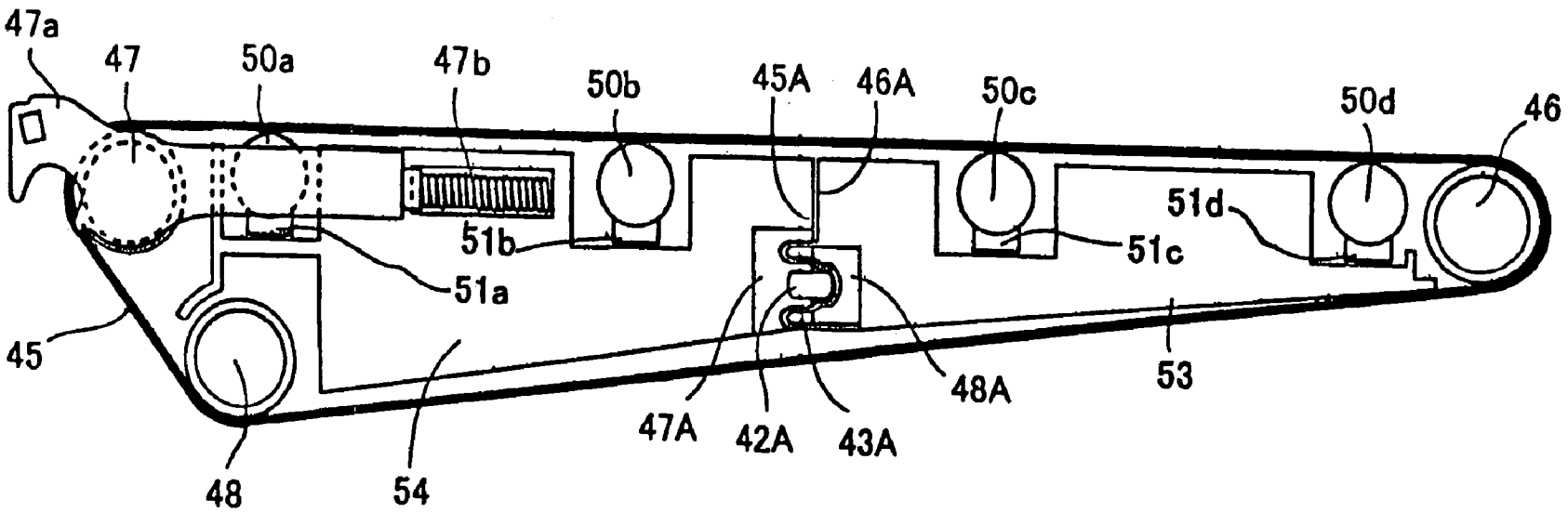
FIG. 11 is an illustrative schematic drawing of a belt supporting frame of an intermediate transfer belt in accordance with another embodiment of the present invention.

Another embodiment of intermediate transfer belt unit 52 is described below. In FIG. 11 belt supporting frame 51 has supporting roller holding member 47*a* which provides support for supporting roller 47. Holding member 47A is movable in the running direction of intermediate transfer belt 45 through a groove provided in unit body 54. The groove in unit body 54 houses spring 47*b*. Spring 47*b* applies force against holding member 47*a* in order for supporting roller 47 to apply tension and stretch intermediate transfer belt 45. Since other elements and actions illustrated by FIG. 11 are the same as those described in FIGS. 5-10, repeated explanations are omitted. Elements in FIG. 11 that are the same are referred to by the same numbers as those in FIGS. 5-10.

Although the embodiment according to the present invention is applied to an image forming apparatus using an endless intermediate transfer belt, the endless belt may also be used as a belt of a photosensitive body drum or as a belt in a transporting device of a last transfer member. When the endless belt according to the present invention is applied to other such apparatuses, the same favorable effects are obtained.

Figure 12:
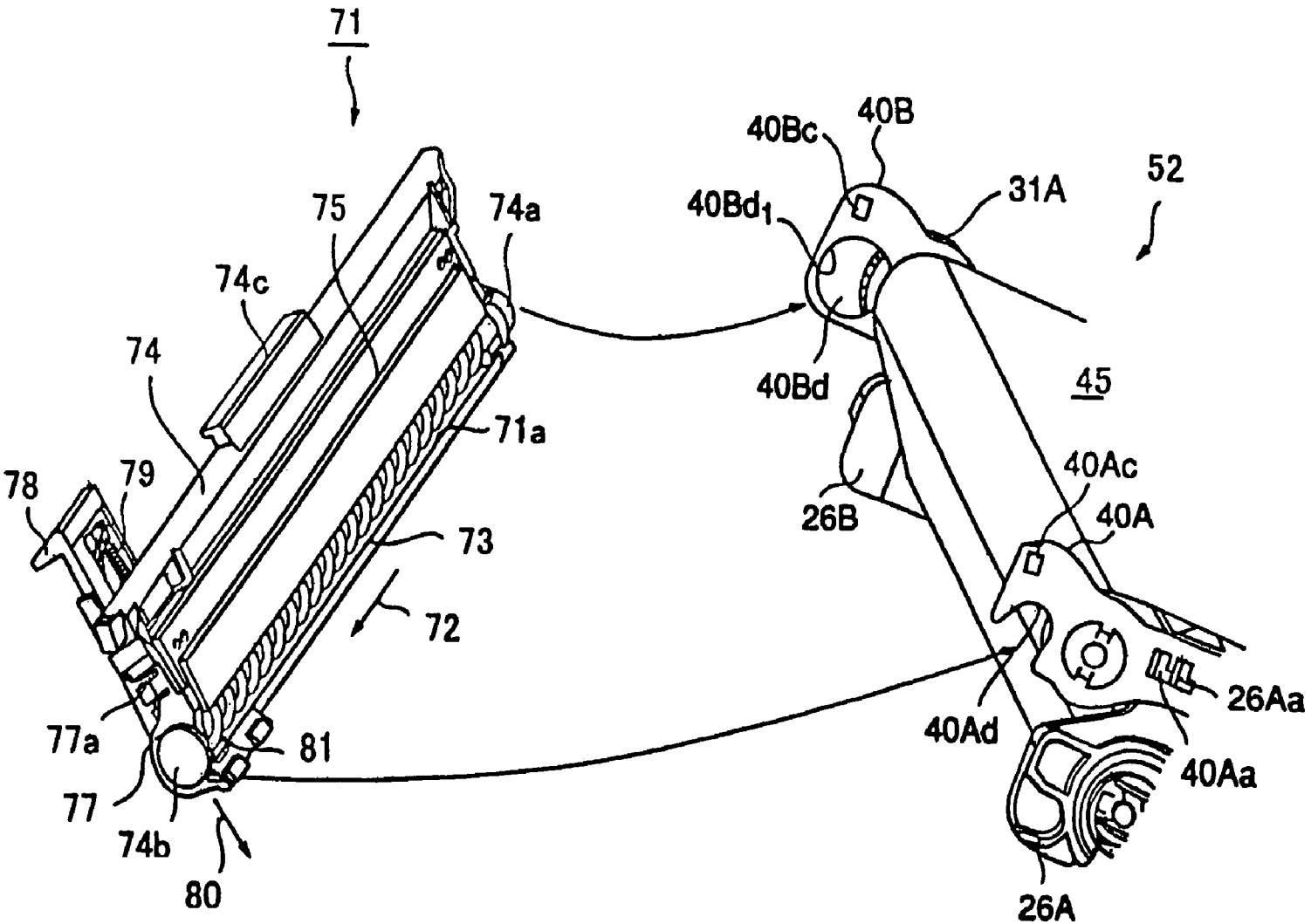
FIG. 12 is a perspective drawing illustrating a procedure for mounting of a cleaning device to a supporting frame of an intermediate transfer belt in accordance with an embodiment of the present invention.

A cleaning device for cleaning residual toner from intermediate transfer belt 45 may be integrated with belt unit 52 of FIGS. 5-10. FIGS. 12-15 illustrate the procedure for mounting a cleaning device to belt unit 52. As shown in FIG. 12, cleaning device 71 has a half cylindrical vacant space (hereinafter "screw chamber") 71*a*. A frame 74 has a rotating screw 73. Rotating screw 73 may transport waste toner into screw chamber 71*a* following the direction of arrow headed line 72. A blade 75 is disposed at the upper part opening of screw chamber 71*a* so as to be properly positioned to scrape residual toner from intermediate transfer belt 45.

An open and shut member 78 is provided on frame 74 of FIG. 12. Open and shut member 78 is capable of seesaw movement on the face opposite blade 75 and is regulated by a spring 79. A shielding member (not shown) of an opening part 81, by which waste toner is rendered to drop in the direction of arrow headed line 80, is provided at the lower end of open and shut member 78. Toner in screw chamber 71*a* is prevented from dropping by shutting opening part 81 when cleaning device 71 is not attached to the image forming apparatus.

Cleaning device 71 also includes a flange part 74*a*. Flange part 74*a* has a coaxial opening with a rotational axis of screw 73. A gear 76, shown in FIG. 13(B), connects to screw 73 through the coaxial opening of flange part 74*a*. A round protrusion 74*b* is provided at the other end of screw 73, opposite the side of flange part 74*a*. A metal fixing chip 77*a*, integrated with frame 74, is provided in the vicinity of round protrusion 74*b*. A fixing part 77 rises along fixing chip 77*a*. A part similar to fixing part 77 is also provided on the side of flange part 74*a* at a position corresponding to fixing chip 77*a*, as shown in FIG. 13 (A).

Figure 13A:
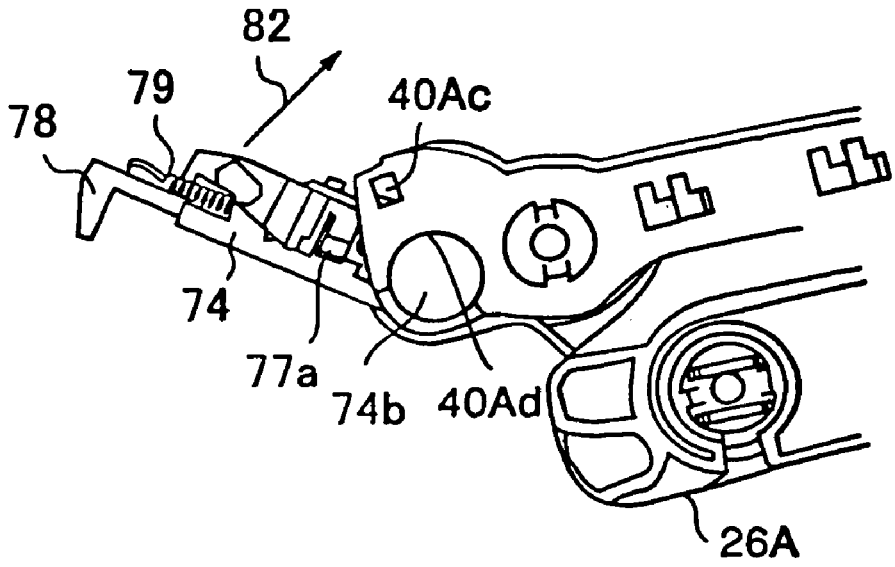
FIG. 13(A) and 13(B) are illustrative schematic drawings of the procedure for mounting the cleaning device to the supporting frame of the intermediate transfer belt of FIG. 12.

A method for mounting cleaning device 71 to belt unit 52 is described as follows. As shown in FIG. 12, flange part 74*a* of frame 74 is fitted in circular opening 40Bd of supporting roller holding member 40B. Flange part 74*a* is circumferentially inserted so that gear 76, of FIG. 13(B), engages a gear 31A of supporting roller 47. Round protrusion 74*b* provided coaxially with screw 73 is fitted and inserted into half circular opening 40Ad of supporting roller holding member 40A. FIGS. 13(A) and 13(B) illustrate cleaning device 71 when it is initially mounted to belt unit 52.

Figure 13B:
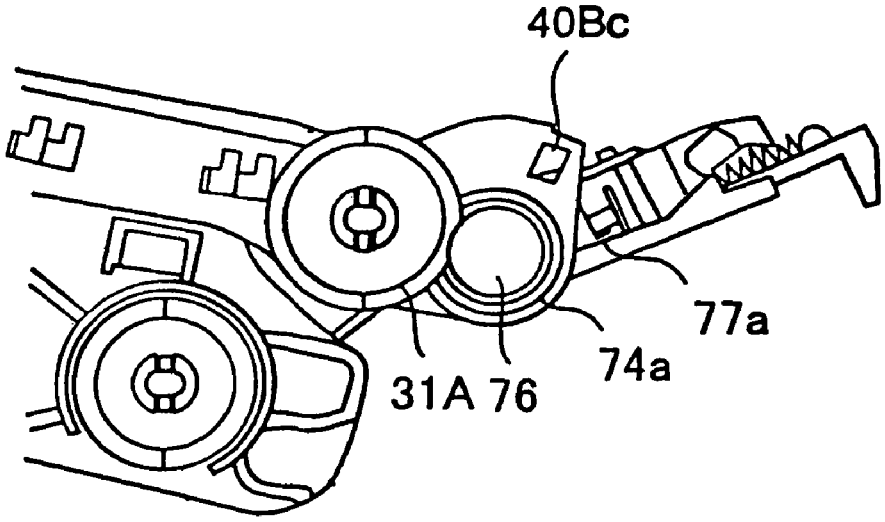
Figure 14A:
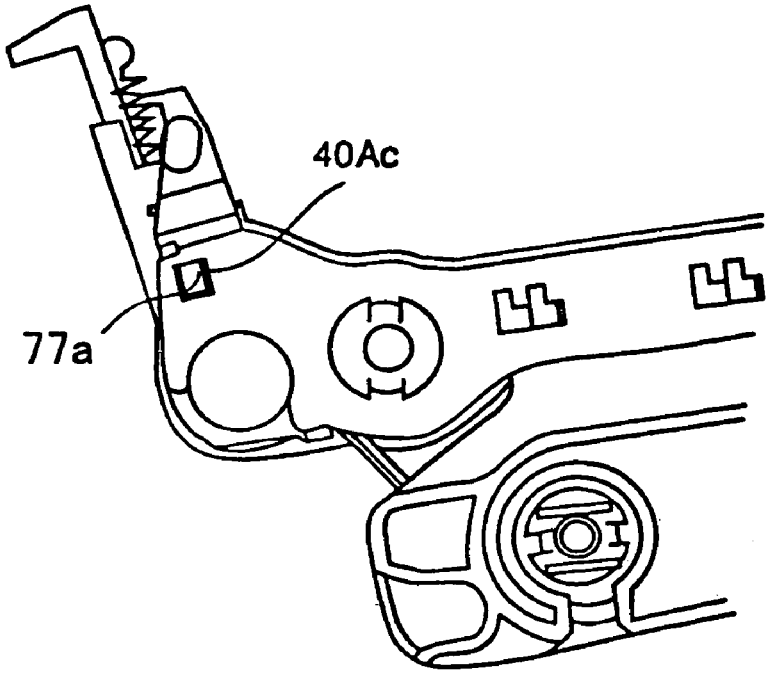
FIGS. 14(A) and 14(B) are illustrative schematic drawings of the cleaning device mounted to the supporting frame of the intermediate transfer belt of FIGS. 12, 13(A) and 13(B).
Figure 14B:
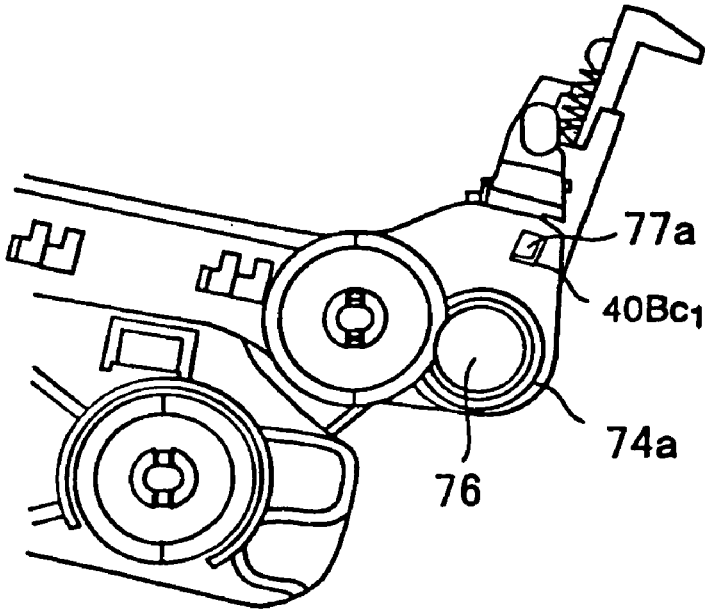

FIG. 13(A) shows an obverse side view of FIG. 12 and FIG. 13(B) shows a reverse side view of FIG. 12. Once cleaning device 71 has been mounted to belt unit 52, frame 74 of cleaning device 71 is turned in the direction of an arrow headed line 82 so as to fit fixing chip 77*a* to positioning hole 40Ac of supporting roller holding member 40A and fit fixing chip 77*a* to positioning hole 40Bc of supporting roller holding member 40B. FIGS. 14(A) and 14(B) illustrate fixing chips 77*a* fitted into positioning holes 40Ac and 40Bc.

Figure 15:
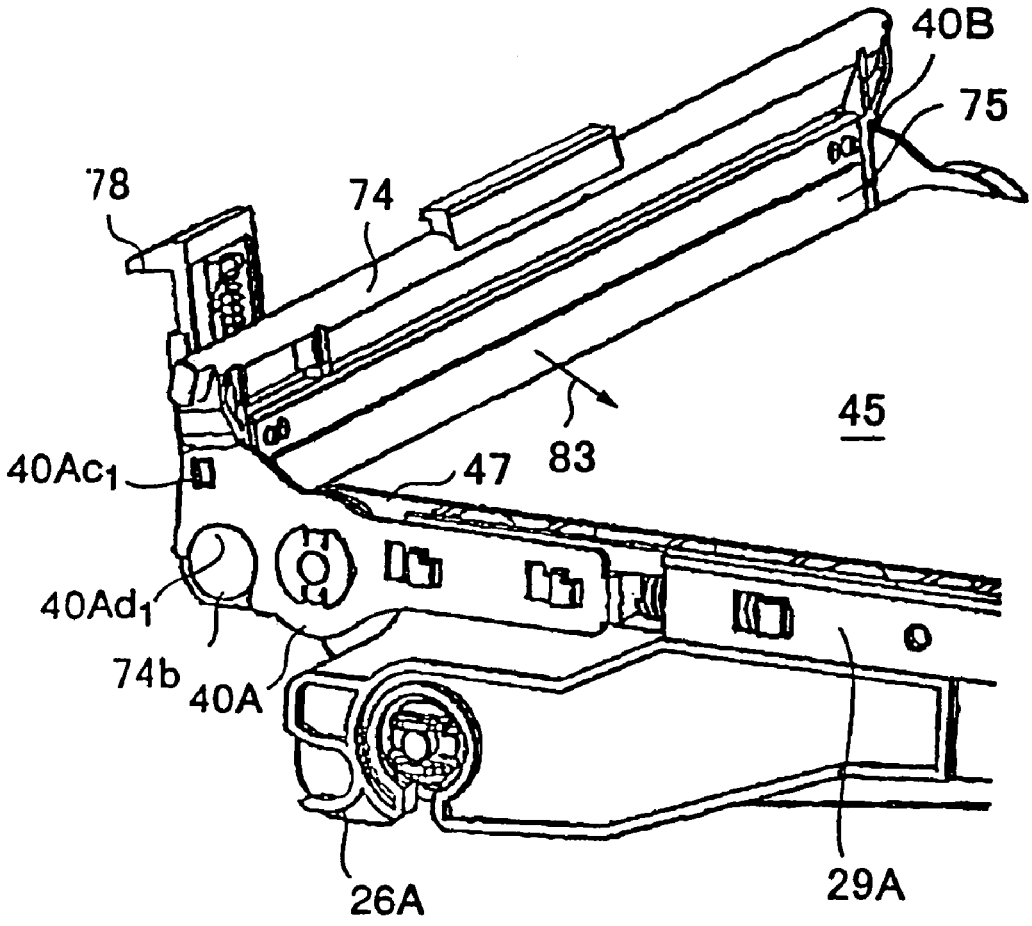
FIG. 15 is a perspective drawing illustrating the cleaning device mounted to the supporting frame of the intermediate transfer belt of FIGS. 12, 13(A), 13(B) and 14.

A perspective view of FIGS. 14(A) and 14(B) is illustrated in FIG. 15. In FIG. 15, the front edge of blade 75 contacts the surface of intermediate transfer belt 45 on supporting roller 47. A side 40$Ac_1$ of positioning hole 40Ac secures fixing chip 77*a* of FIG. 14(A) in the direction indicated by an arrow headed line 83, pressing blade 75 against the circumferential surface of intermediate transfer belt 45. A left lateral brim 40$Ad_1$ of half circular opening 40Ad (FIG. 12) supports the rotational axis part of round protrusion 74*b*. Likewise, on the side with supporting roller holding member 40B, a side 40$Bc_1$ of opening part 40Bc secures fixing chip 77*a* of FIG. 14(B) in the direction indicated by arrow headed line 83, pressing blade 75 against the circumferential surface of intermediate transfer belt 45. Left lateral brim 40$Bd_1$ of circular opening 40Bd (FIG. 12) supports the rotational axis part of flange part 74*a*.

Hence, frame 74 is provided on supporting roller holding members 40A and 40B, where it is rotated to hold supporting roller 47 in such a manner that frame 74 is capable of turning about the rotational axis of screw 73. Opening parts 40Ac and 40Bc are provided on supporting roller holding members 40A and 40B, respectively, for receiving fixing chips 77*a*. Opening parts 40Ac and 40Bc simplify the attachment of frame 74 of cleaning device 71 to belt unit 52 while avoiding bothersome operations for mounting, such as fixing with screws.

Blade 75 is fixed to a predetermined position by turning frame 74 around the rotating axis of screw 73 to fit fixing chips 77*a* to opening parts 40Ac and 40Bc. A pressing position of blade 75 on the circumferential surface of intermediate transfer belt 45 is found first and then fitting of fixing chips 77*a* to opening holes 40Ac and 40Bc is positioned accordingly, while holding constant the pressing position of blade 75. Therefore, two fixing steps are taken when positioning blade 75, the first being fitting of round protrusion 74*b* and flange part 74*a* to openings 40Ad and 40Bd, respectively, and the second being fitting fixing chips 77*a* to positioning holes 40Ac and 40Bc. Such a design results in a smooth cleaning action, while preventing fluctuation of a load on the edge of blade 75 to the surface of intermediate transfer belt 45.

While sustaining supporting roller 47 and cleaning device 71 and being pressed with a force by spring 41A to help supporting roller 47 produce tension in intermediate transfer belt 45, holding members 40A and 40B are made capable of moving lineally. The lineal movement helps to maintain a contact position of blade 75 with intermediate transfer belt 45, while also assisting blade 75 to maintain a constant distance without varying the contact position of blade 75 to the intermediate transfer belt 45.

Tensioning of intermediate transfer belt 45 through the combined efforts of spring 71A, holding members 40A and 40B and supporting roller 47, as described in detail above, is advantageous. If positioning in, or members of, the image forming apparatus, such as, a tension roller fixing axis position, a driving roller axis position, an endless belt or other applicable members, have manufacturing errors, the errors may be remedied through linear adjustment of holding members 40A and 40B. Even errors pertaining to altered dimensions of intermediate transfer belt 45, for example, a manufacturing error resulting in the variation of tensile strength from standard values of a material used in intermediate transfer belt 45 or deterioration of intermediate transfer belt 45 with age, may be remedied through linear adjustment of holding members 40A and 40B. Such problems may be corrected through linear adjustment of holding members 40A and 40B while still maintaining the position where blade 75 contacts intermediate transfer belt 45 at a constant distance, due to holding members 40A and 40B being varied in the tension direction.

As intermediate transfer belt 45 turns about intermediate transfer belt unit 52, waste toner collected on the surface of intermediate transfer belt 45 is scraped by blade 75 of cleaning device 71. Waste toner scraped by blade 75 and collected in screw chamber 71*a* is discharged from opening 81 of cleaning device 71 by rotating gear 76 (FIG. 13(B)). Gear 76 is engaged by rotating gear 31A of supporting roller 47. Intermediate transfer belt unit 52 attached with cleaning device 71 is described further with reference to FIGS. 2, 16 and 17.

Figure 16:
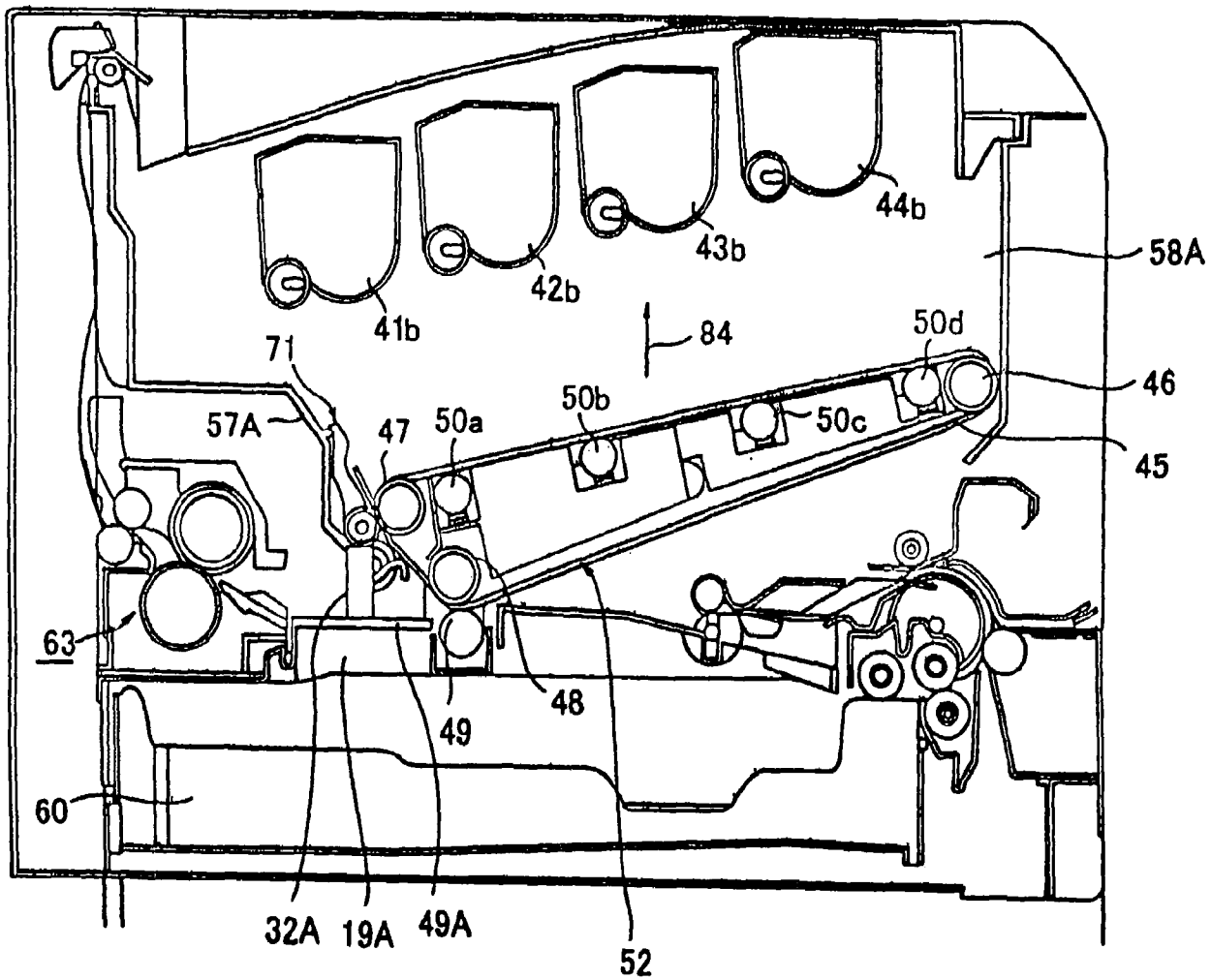
FIG. 16 is an illustrative schematic drawing of a procedure for detaching an intermediate transfer belt unit in accordance with an embodiment of the present invention.
Figure 17:
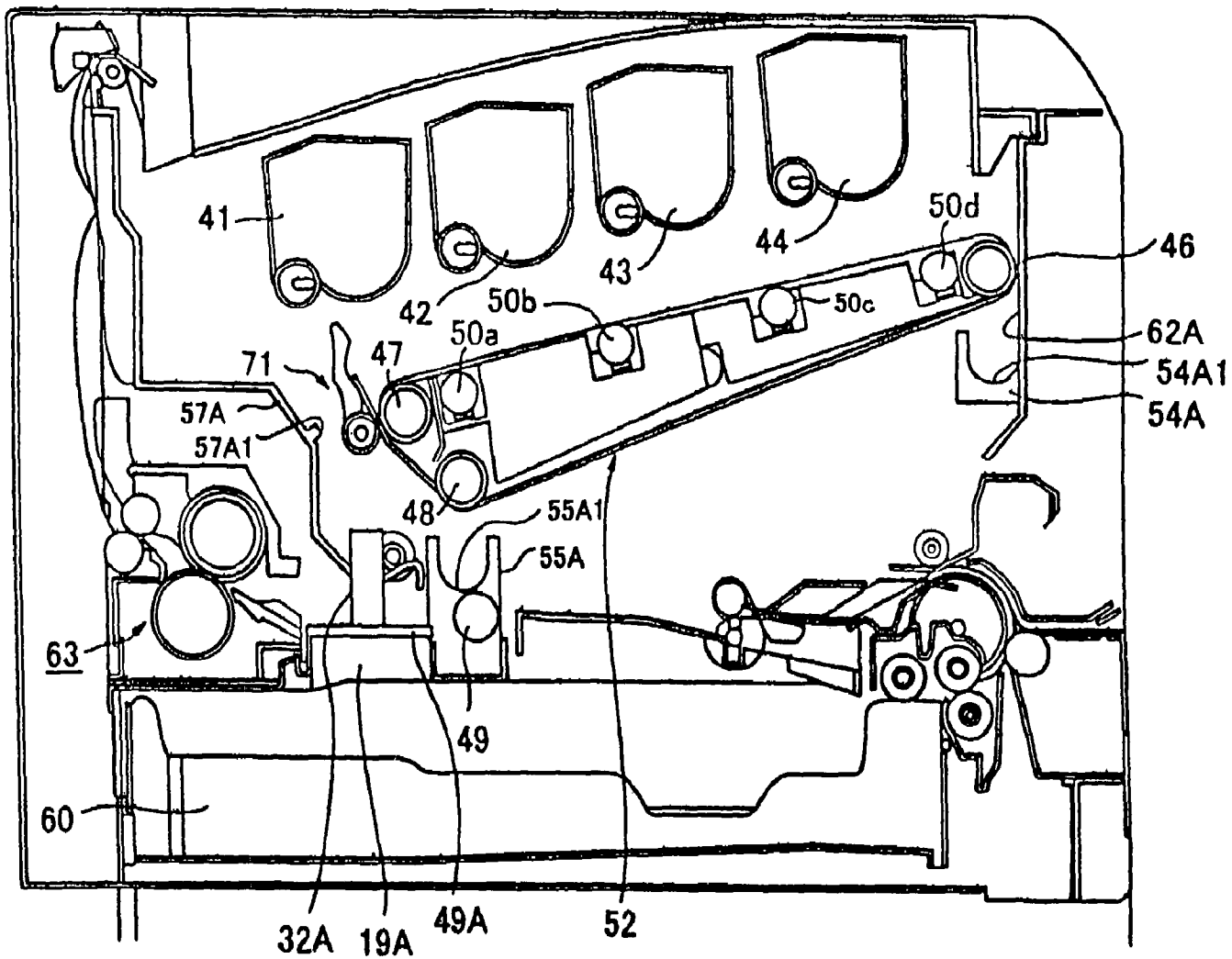
FIG. 17 is another illustrative schematic drawing of the procedure for detaching the intermediate transfer belt unit of FIG. 16.

When components of image forming units 41-44, shown in FIG. 2, are separated from the surface of intermediate transfer belt 45 and removed from the image forming apparatus, as illustrated in FIG. 16, an open area 58A is created. Belt unit 52 is lifted in the direction indicated by arrow headed line 84, with a gripping means (not shown) provided on belt unit 52, into open area 58A. Lifting belt unit 52 into open area 58A forces open and shut member 78 (FIG. 15), which controls opening of opening part 81 to create a port for discharging waste toner collected in screw chamber 71*a* of cleaning device 71, to be closed by spring 79 (FIG. 13(A)). FIG. 17 illustrates belt unit 52 in its lifted position within open area 58A with open and shut member 78 in a position closing opening part 81.

FIG. 17 further shows a first guide 54A and a second guide 55A integrated into the main body of the image forming apparatus. First guide 54A has a U-shaped guide face making contact with a guide wall 62A. A protruded part (not shown) capable of fitting to the U-shaped guide face of first guide 54A is provided coaxially with driving roller 46. Likewise, a protruded part (not shown) capable of fitting to the U-shaped guide face of second guide 55A is provided coaxially with backup roller 48. When the protruded parts of first guide 54A and second guide 55A are separated, belt unit 52 is easily removed from the main body of the image forming apparatus.

In order for belt unit 52 to be mounted onto the main body of the image forming apparatus shown in FIG. 17, the right side of the protruded part of first guide 54A is first placed against guide wall 62A and belt unit 52 is lowered. As belt unit 52 is lowered, protruded parts of first guide 54A and second guide 55A are fitted to the U-shaped guide faces of first guide 54A and second guide 55A. This results in belt unit 52 being mounted onto mounting stages 54A1 and 55A1. When open and shut member 78 (FIG. 15) makes contact with a protrusion 57A1 of an insulating wall 57A, opening part 81 is allowed to open. Opening of opening part 81 creates a pathway to waste toner pipe 32A.

Figure 18:
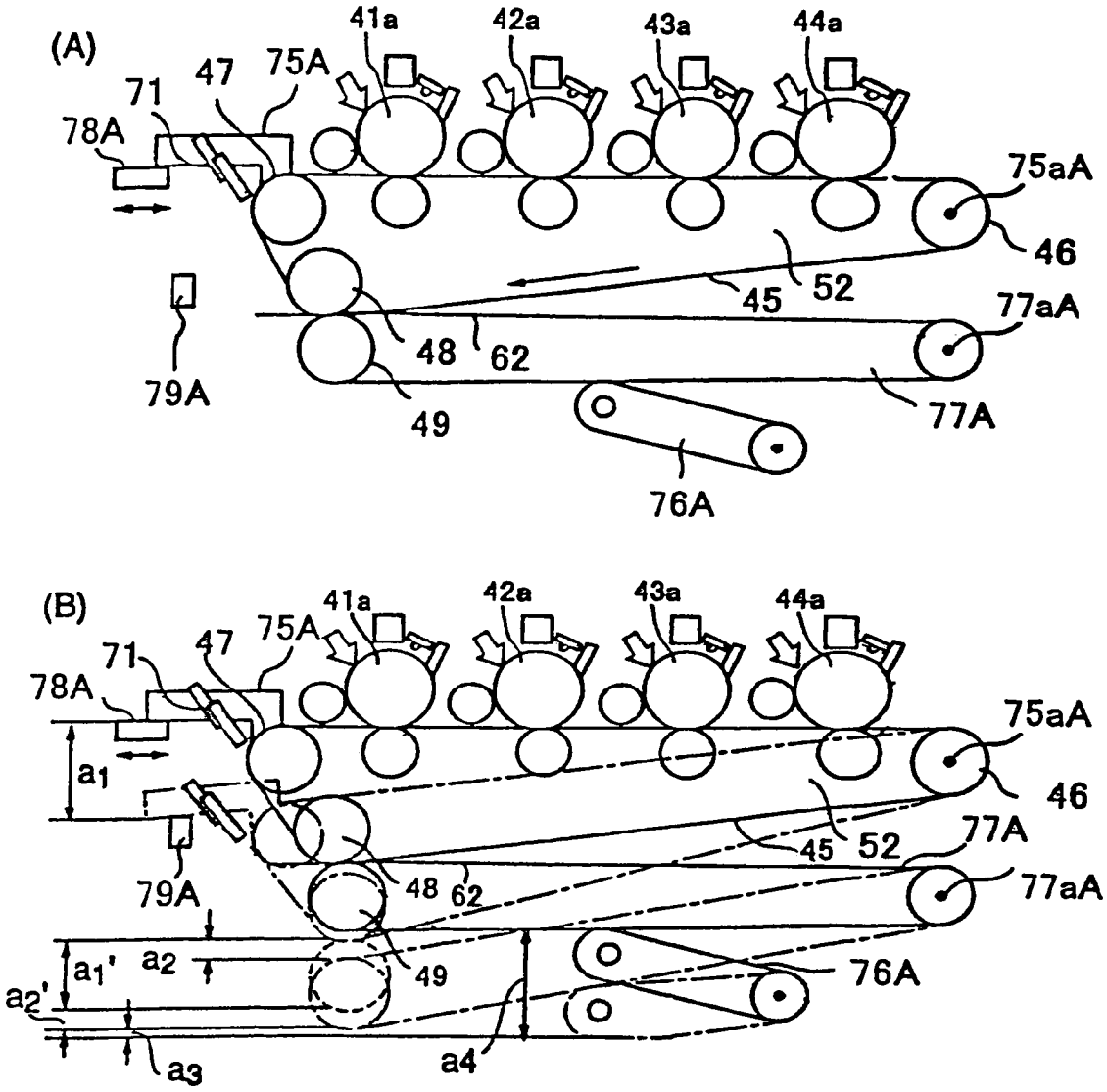
FIGS. 18(A) and 18(B) are illustrative schematic drawings of a structure encompassing an intermediate transfer belt of an image forming apparatus in accordance with an embodiment of the present invention.

In FIG. 18, a side panel 75A is provided as a component of belt unit 52. Side panel 75A is capable of turning about a point 75*a*A, traveling between a fixed device position, a fixing member 78A, that is disposed in a way to allow it to move left and right and a fixed departing position, a fixing member 79A, that is capable of being drawn to the front. Likewise, a transporting unit 77A is capable of turning about a point 77*a*A. When photosensitive body drums 41*a*-44*a* make contact with intermediate transfer belt 45 in state (A), as illustrated in FIG. 18, counterclockwise turning of intermediate transfer belt 45 is blocked by fixing member 78A. Counterclockwise turning of transporting unit 77A is prevented by a fixing lever 76A when intermediate transfer belt 45 contacts secondary transfer roller 49 in state (A).

When photosensitive body drums 41*a*-44*a* are disposed on the upper surface of belt unit 52, as shown in state (B), belt unit 52 needs to be moved apart from photosensitive body drums 41*a*-44*a* in the downward direction. In order to prevent intermediate transfer belt 45 from making contact with photosensitive body drums 41*a*-44*a*, belt unit 52 is moved a distance $a_1$. Accordingly, transporting unit 77A is moved downward a distance $a_2$ in order to set apart an appropriate distance between transporting unit 77A and belt unit 52. With this regard, transporting unit 77A needs to be moved downward a distance $a_1'$, corresponding to the distance $a_1$, and a distance $a_2'$, corresponding to the distance $a_2$. Moving zone $a_4$ is necessary under transporting unit 77A for moving transporting unit 77A up and down using fixing lever 76A. Protrusion $a_3$ on the side of the dashed line of fixing lever 76A is further necessary. Therefore, transporting unit 77A needs space equal to the sum of distances $a_1'+a_2'+a_3$ under transporting unit 77A.

If components of image forming units 41-44, shown in FIG. 2, are separated from the surface of intermediate transfer belt 45 and removed from the image forming apparatus, as illustrated in FIG. 16, for the distance $a_1$, the space where the components of the image forming apparatus were disposed remains as opening area 58A. Then, when belt unit 52 is lifted up toward opening area 58A and is drawn to front, the appropriate distance $a_2'$, fixing lever 76A and the protrusion for fixing lever 76A become unnecessary. The capacity (W) for fixing lever 76 and the space ($a_2'+a_3+$ W) become unnecessary, resulting in a more compact and easy-to-handle image forming apparatus.

The use of intermediate transfer belt 45 is not limited to the embodiments of the present invention described above. Since an endless intermediate transfer belt may also be used as a photosensitive body or transporting device for a last transporting member, advantages of the embodiments described above may also be applied to such devices. Furthermore, the present invention is not limited to blade 75 for scraping waste toner. A fur brush, or any other suitable device, may be used as an alternative in the image forming apparatus.

Figure 19:
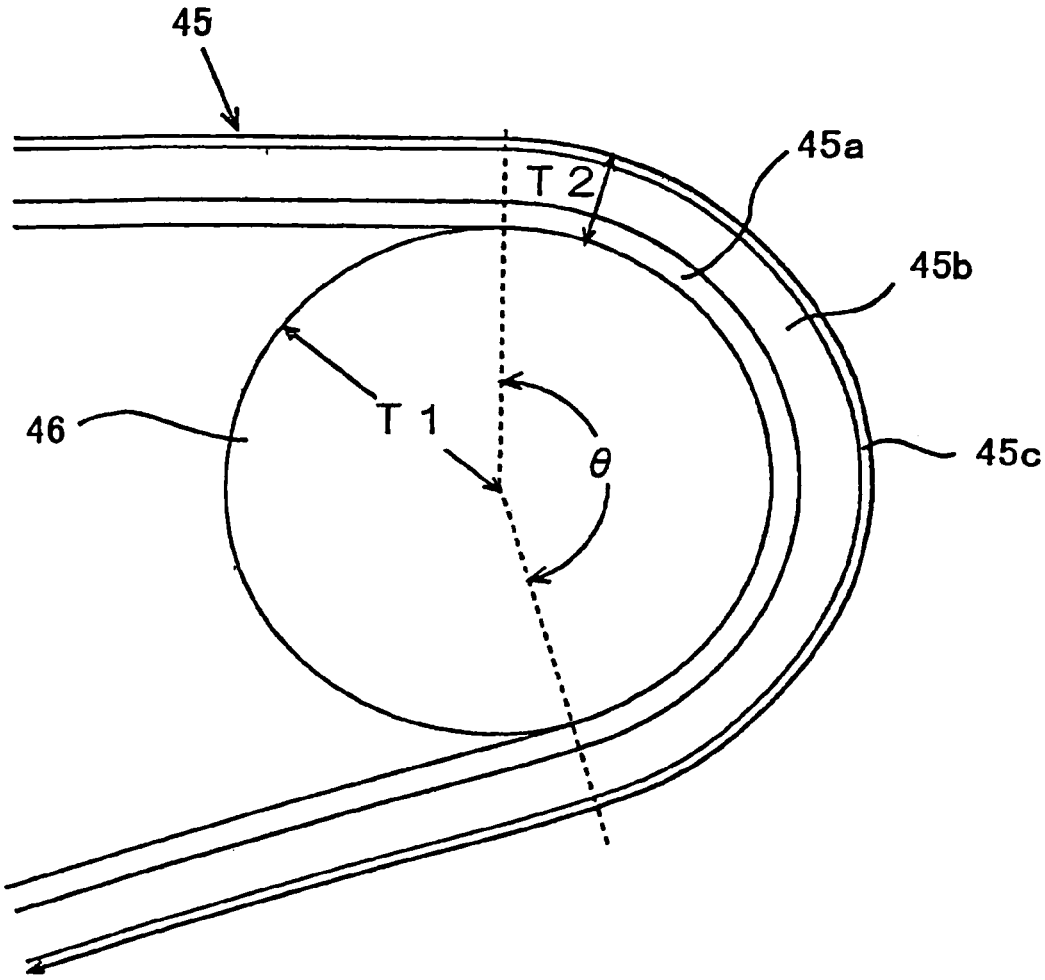
FIG. 19 is an enlarged illustrative schematic drawing of a driving roller in accordance with an embodiment of the present invention.

The structure of intermediate transfer belt 45 is described in FIG. 19. Intermediate transfer belt 45 consists of a base material layer 45*a*, an elastic material layer 45*b* and a releasing material layer 45*c*. A small elongation of base material layer 45*a* may absorb shock generated at the time of starting drive of intermediate transfer belt 45. An elongation of elastic material layer 45*b* and releasing material layer 45*c* may absorb distortion generated by a maximum curvature of driving roller 46. Overall, intermediate transfer belt 45 sustains good durability and provides a measure for color drift or image defects (e.g., an image without midsection). Furthermore, an opportunity to provide more stable transferring is possible by setting a volume resistivity of intermediate transfer belt 45 larger toward the surface layer.

A film material having a thickness of 50 μm to 150 μm and a resistivity of $10^{10}\Omega$cm is favorable for base material layer 45*a*. Base material layer 45*a* is required to accurately communicate rotational energy from driving roller 46. Therefore, a particular strength is necessary so that a ratio of an elongation before intermediate transfer belt 45 is communicated with the driving force of driving roller 46 to an elongation after it leaves driving roller 46 is preferably 1-10%. A material such as polycarbonate (PC), nylon (PA), polyester (PET), polysulphon (PSU), poyethersulphon (PEI), polyetherketon (PEEK), thermoplastic polyimid (TPI), thermosetting polyimid (PI), polyvinylidenefluoride or etylene-tetrafluoroetylene copolymer may be used as a material for base material layer 45*a*. Base material layer 45*a* may be formed by a method using inflation or extrusion, adding an electrically conductive material to one of the listed materials above, such as, carbon black.

A rubber material such as styrene-butadiene rubber, butadiene rubber, ethylene-propylene rubber, chloroprene rubber, acrylonitrile-butadiene rubber, fluoropolymer rubber or polyurethan rubber may be used for elastic material layer 45*b*. A material having a predetermined resistivity may be obtained by adding an electrically conductive material, such as, carbon black, aluminum powder, nickel powder or tin oxide powder to one of the aforementioned rubber materials. As an alternative, an ionic additive or an electrically conductive resin may be added to one of the aforementioned rubber materials. However, one is not limited to use of one of the aforementioned materials. One kind of aforementioned material with additives or a plurality of the aforementioned materials with additives may be mixed and used.

The thickness and elongation of elastic material layer 45*b* is important for controlling formation of transfer nip, color drift or scattering of toner. Therefore, elastic material layer 45*b* should have a thickness between the range of 100 μm-1000 μm, more preferably 300 μm-700 μm, and a ratio of an elongation before intermediate transfer belt 45 is communicated with the driving force of driving roller 46 to an elongation after it leaves driving roller 46 is preferably 2-10%. If the thickness is less than 100 μm, enough transfer nip can not be taken. If the thickness is greater than 1000 μm, it surpasses a range for use of the belt.

Releasing material layer 45*c* communicates softness of elastic material layer 45*b* to the surface of photosensitive body drums 41*a*-44*a*. Releasing layer 45*c* is softer and thinner than the other layers of intermediate transfer belt 45 and is preferably 3 μm -15 μm in thickness. The proper releasing effect, as well as durability, is not obtained if the thickness of releasing material layer 45*c* is less than 3 μm. If the thickness is greater than 15 μm, the elastic nature of releasing material layer 45*c* is affected negatively so as not to be able to obtain enough transfer performance.

A predetermined layer may be obtained for releasing material layer 45*c* by heating a material consisting of 40 parts of urethane resin binder dispersed with 60 parts of PTFE latex. Since releasing material layer 45*c* is the outer most surface of intermediate transfer belt 45, a higher stability of elasticity than that of elastic material layer 45*b* is required. A typical fluorocarbon resin is polytetrafluoroethylene (PTFE), a copolymer of tetrafluoroethylene and hexa fluoropropyrene (PREP), and a copolymer of tetrafluoroethylene or perfluoroalkyl vinyl ether. These materials are used individually or as a mixture of two kinds or more. Releasing material layer 45*c* is formed by methods such as dipping method, roller coating method, doctor blade method, spray method or electrostatic coating method.

When driving roller 46 has a sufficiently big diameter, the plastic deformation of intermediate transfer belt 45 need not be considered. However, as the diameter of driving roller 46 becomes smaller, intermediate transfer belt 45 is prone to large distortions on driving roller 46. Such a distortion may lead to a crack or color drift to be generated when used, eventually causing degradation of intermediate transfer belt 45. When the diameter of driving roller 46 becomes too large, the main body of the image forming apparatus becomes to big. For this reason, a driving roller having a diameter of less than 25 mm and a surface treated with ceramic particles and controlled to a surface roughness of Rz=1~15 μm is used. If a surface roughness is 1 μm or greater, then stable transportation by intermediate transfer belt 45 is realized. It is unfavorable to have a surface roughness of 15 μm or greater because base material layer 45*a* may become largely distorted and convexity and concavity are remained on the surface of intermediate transfer belt 45 to which a driving force is communicated because of concentrated stress to the ceramic particles.

It is favorable that toner of a non-magnetic type and $TiO_2$ treated with a lubricating treating agent, for the purpose of decreasing friction on the surface of intermediate transfer belt 45, be used as a developer material of the image forming apparatus using intermediate transfer belt 45. The $TiO_2$ may be replenished at the time of transferring as part of the transfer toner and further at the time of developing for the purpose of providing periodical cleaning to intermediate transfer belt 45. A lubricating treating agent residing on intermediate transfer belt 45, together with toner, is coated on the surface of releasing material layer 45*c* in the cleaning process. This prevents paper powder or toner ingredient from adhering to the surface, which in turn prevents an image from deteriorating as a result of absorption of water from a humid environment and enables stable rotation of driving roller 46 of a small diameter by decreasing driving torque. Various fatty acids such as stearic acid and their metal salt or amide can be used as such lubricating agents.

FIG. 20 is a table of data results compiled from testing various diameter measurements for driving roller 46, thickness measurements for intermediate transfer belt 45, and materials for components of intermediate transfer belt 45. Labels "base material layer", "elastic material layer" and "releasing material layer" provided in the table of FIG. 20 correspond to base material layer 45*a*, elastic material layer 45*b* and releasing material layer 45*c*, respectively, of FIG. 19. Label "T1" is a radius value (measured in millimeters) of driving roller 46. Label "T2" is a whole thickness value (measured in millimeters) of intermediate transfer belt 45. Label "A" is a ratio (identified as a percentage value) of an elongation of the outer diameter to that of the inner diameter of the part of intermediate transfer belt 45 which contacts driving roller 46. A relationship between "T1", "T2", an angle θ of the part where intermediate transfer belt 45 contacts driving roller 46 and a elongation ratio "A" is expressed as:

$$A = \left( \frac{2\prod(T1 + T2) - 2\prod T1}{2\prod(T1 + T2)} \right) \times 100\% \quad (1)$$

Label "B" is a ratio (identified as a percentage value) of an elongation before intermediate transfer belt 45 is communicated with the driving force of driving roller 46 to an elongation after it leaves driving roller 46. This ratio may be determined by calculating the ratio of a running rate of intermediate transfer belt 45 running between supporting roller 47 and driving roller 46 to a running rate of intermediate transfer belt 45 running between driving roller 46 and backup roller 48. Due to a tensile force, the running rate from supporting roller 47 to the maximum bending point of driving roller 46 is greater than the running rate from driving roller 46 to the maximum bending point of backup roller 48.

Label "A+B" expresses an elongation of the whole intermediate transfer belt 45 equal to elongation ratio "A" of intermediate transfer belt 45 at driving roller 46 added to elongation ratio "B" of intermediate transfer belt 45 at before-and-after driving roller 46. The columns labeled "image without midsection" and "color drift" in the table of FIG. 20 denote states of the image without midsection and the color drift at printing, respectively. The column labeled "100,000 sheets durability" denotes the state of stability after 100,000 sheets of paper are printed by the image forming apparatus illustrated in FIG. 3.

In "Example 1" of FIG. 20, film having a thickness of 100 μm is made for an endless resin belt by extruding polyfluorovynilidene (PVdF). The film is then mounted to the image forming apparatus of FIG. 3 for purposes of evaluation. The apparatus is driven by driving roller 46 having a diameter of 22 mm ("T1" is 11 mm long). Measurements are taken for a running rate of the film from supporting roller 47 to driving roller 46 and from driving roller 46 to backup roller 48 of FIG. 3. The elongation ratio "B" calculated from resultant values of the rates is found to be 2%. Elastic material layer 45*b* is composed of Chloroprene rubber (CR) and is made to have a thickness of 390 μm. The CR layer of elastic material layer 45*b* is adhered to the PVdF film of basic material layer 45*a*, as shown in FIG. 19. After polishing the surface of the CR layer, the surface is coated with aqueous polyfluorocarbon latex having a thickness of 10 μm to form releasing material layer 45*c*. It is then cured at a temperature of 180° to form a composite belt. As a result, the thickness "T2" of intermediate transfer belt 45 is 500 μm (0.5 mm) with a resulting elongation ratio of 4.34% for "A". Since releasing material layer 45*c* has an elasticity more resilient than elastic material layer 45*b*, the layer does not suffer cracks caused by elongation of elastic material layer 45*b*. With the aforementioned specifications for "Example 1", the "image without midsection", "color drift" and "100,000 sheets durability" categories provided in the table of FIG. 20 yield positive results.

In "Example 2" of FIG. 20, nylon 66 having a thickness of 100 μm is used as an alternative to polyfluorovynilidene (PVdF) for base material layer 45*a*. This results in elongation ratio "B" having a value of 4%. However, the "image without midsection", "color drift" and "100,000 sheets durability" categories continue to yield positive results In "Example 3" of FIG. 20, PVdF having a thickness of 100 μm is used for base material layer 45*a* and CR having a thickness of 590 μm is used for elastic material layer 45*b*. Accordingly, although the values of radius "T2" and ratio "A" are 700 μm and 5.98%, respectively, the "image without midsection", "color drift" and "100,000 sheets durability" categories continue to yield positive results like that of "Example 1" and "Example 2".

In "Comparative example 1" of FIG. 20, driving roller 46 having a radius "T1" value of 17 mm is used. Nylon 66 having a thickness of 100 μm, same as the thickness used in "Example 2", is used for base material layer 45*a*, CR having a thickness of 390 μm, same as the thickness used in "Example 1", is used for elastic material layer 45*b* and aqueous polyfluorocarbon latex film having a thickness of 10 μm, same as the thickness used in "Example 1", is used for releasing layer 45*c*. The value of elongation ratio "B" is the same as proscribed in "Example 2". However, as a result of radius "T1" being larger, elongation ratio "A" yields 2.85% and thus the value of "A+B" becomes 6.85. This results in reduced ratio values compared to that of "Example 2". The "image without midsection", "color drift" and "100,000 sheets durability" continued to yield positive results in this comparative example. The only negative outcome results from the increase in radius size of driving roller 46, forcing the apparatus to have to become larger to accommodate the sizing adjustment.

In "Comparative example 2" of FIG. 20, driving roller 46 with a radius "T1" of 22 mm, base material layer 45*a* composed of thermoplastic elastomer having a thickness of 100 μm, same as the thickness used in "Example 2", elastic material layer 45*b* composed of CR having a thickness of 390 μm, same as the thickness used in "Example 1", and releasing material layer 45*c* composed of aqueous polyfluorocarbon latex film having a thickness of 10 μm, same as the thickness used in "Example 1" are used. As a result of increasing radius "T1", compared to the radius "T1" of "Example 2", elongation ratio "A" decreases to 2.22%. Elongation ratio "B" and "A+B" increase to 15% and 17.22, respectively, because of the use of thermoplastic elastomer. These changes cause the elongation of intermediate transfer belt 45 to significantly increase, which in turn yields intensified "color drift" and a poor durability rating (Δ) in the "100,000 sheets durability" category of FIG. 20.

In "Comparative example 3" of FIG. 20, driving roller 46 having a radius "T1" of 11 mm, the same as used in Examples 1-3, and base material layer 45*a* composed of polyimide having a thickness of 100 μm, which had very little elongation, is used. Elastic material layer 45*b* and releasing material layer 45*c* are excluded from the composition of the belt in this comparative example. The resulting values of "T2", "A", "B" and "A+B" yield 0.1 mm, 0.90%, 0% and 0.90, respectively. This values ultimately result in an image without midsection and poor durability.

Referring to the aforementioned results of the table in FIG. 20, an appropriate range for elongation ratio "A" may be determined. "Comparative example 1" exhibits positive results in all three categories of "Image without midsection", "Color drift" and "100,000 sheets durability". "Comparative example 2" yields positive results for the "Image without midsection" category, however, it also results in color drift and poor durability. "Comparative example 3" only yields a positive result for the "Color drift" category. From these results, it can be determined that the minimum value of "A" should not fall below a value of 2%, however, it is more preferable to have a value of 3% or greater. The maximum value of "A" should not be larger than the range of 6% to 7% based on the value of elongation ration "A" of "Example 3", 5.98%. Hence, positive results in image quality and dura bility are generally obtained within the following elongation ratio range of "A":

$$3\%<A<7\% \quad (2)$$

Color drift and durability may be directly impacted by the value of elongation ratio "B". When elongation ratio "B" has a value that is too high, for example, 15% as in "Comparative example 2", color drift is generated. When elongation ratio "B" has a value that is too low, for example, 0% as in "Comparative example 3", durability is compromised. Minimized color drift and improved durability are associated with an elongation ratio "B" ranging between 2% and 4%. Color drift does not become a problem when elongation ratio "A" is too low, for example, 0.90% as in "Comparative example 3". Therefore, elongation ratio "A" ranging between 1% and 6% in value may be adopted. Positive results are generally obtained when "A+B", which expresses elongation of a whole intermediate transfer belt 45, falls within the following range:

$$3\%<A+B<10\% \quad (3)$$

A ratio of elongation in material layer 45*a* before intermediate transfer belt 45 is communicated with the driving force of driving roller 46 to an elongation after it leaves driving roller 46 having a minimum value of 1%, while also having an acceptable minimum value for ratio "A" between 2% and 3%, satisfies inequality (3). With regards to color drift, since it is generated when elongation ratio "B" is 15%, inequality (3) is satisfied with a maximum elongation value of 10%. Therefore, a range between 1% and 10% satisfy the conditions above.

Since elongation of elastic material layer 45*b* is a dominant parameter and the minimum elongation ratio of "A" is preferably between 2% and 3%, the minimum ratio value needs to be 2% to satisfy inequality (3). Furthermore, completely satisfying the set value may be obtained if the maximum elongation ratio of "B" has a value of 10%.

A similar extent of elongation of base material layer 45*a* is needed to allow for the proper elongation of elastic material layer 45*b*. An elongation ratio value between 2% and 10% for elastic material layer 45*b*, keeping in consideration the maximum value of 10% for ratio "B" of base material layer 45*a*, will satisfy the conditions required.

Although the invention has been described with reference to the preferred embodiments, it will be apparent to one skilled in the art that variations and modifications are contemplated within the spirit and scope of the invention. The drawings and description of the preferred embodiments are made by way of example rather than to limit the scope of the invention, and it is intended to cover within the spirit and scope of the invention all such changes and modifications.

We claim:

1. An image forming apparatus comprising:

a primary transfer part for primarily transferring onto its circling surface a toner image carried on a photoreceptor;

a plurality of image forming units wherein said photoreceptor installed in each image forming unit is arranged along a circling direction of said primary transfer part;

an intermediate transfer unit having a secondary transfer roller positioned at a secondary transfer position of said toner image, said secondary transfer position being positioned at a downstream of said primary transfer part;

an intermediate transfer body which is an endless circling body carried along a prescribed transporting pathway; and a first roller, a second roller, and a third roller, wherein said transporting pathway is inclined upwardly along said primary transfer part in the direction from a down-most image forming unit to an up-most forming unit, wherein said first roller is configured to transport said intermediate transfer body, said second roller is configured to give tension to said intermediate transfer body and said third roller opposes said secondary transfer roller;

wherein said primary transfer part is defined between said first roller and said second roller; and wherein said intermediate transfer body installed in said intermediate transfer unit is an intermediate transfer belt, further comprising a cleaning mechanism having a cleaning member which is pressed on surface of said belt for cleaning paper powders or toners left on said surface of said belt, a rotational shaft and a cleaning mechanism frame, wherein said rotational shaft is detachably and rotatably attached to a belt supporting frame that supports the intermediate transfer belt, and wherein said cleaning mechanism frame rotates with the rotation of the rotational shaft such that the cleaning mechanism frame faces said belt supporting frame fixing both frames at a point where said cleaning member presses against a circling surface of the endless belt; and the image forming apparatus wherein said intermediate transfer unit frame has a circular hole opening and an arc hole opening for catching said rotational shaft.

2. The image forming apparatus according to claim 1, wherein the cleaning mechanism frame is configured to turn parallel to a wall of the belt supporting frame;

wherein a fitting member is provided on a face of one of said cleaning mechanism frame and said belt supporting frame, while the other frame comprises fitting apertures, and wherein said fitting member is being fitted into said fitting apertures at a position corresponding to said point where said cleaning member presses against said endless belt.

3. The image forming apparatus according to claim 1, wherein said circular hole opening and said arc hole opening are positioned such that a supporting face of said arc hole opening is opposed to a circumferential surface pressing direction of said endless belt.

4. The image forming apparatus according to claim 1, wherein said cleaning mechanism further comprises a driving system driving a screw which regulates discharging of residual toner, said driving system being connected to a side of said rotational shaft facing said circular hole opening.

5. The image forming apparatus according to claim 1, which further comprises an elastically controlled shutter mechanism opening and closing a discharge opening of a waste toner container located adjacently to the cleaning mechanism.

6. The image forming apparatus according to claim 5, wherein an end of an elastic member for opening and closing said discharge opening is attached to the image forming apparatus itself or a part of its fixed member, said elastic member being attached to said shutter mechanism, wherein said shutter mechanism is maintained in an opened state by a spring force of said elastic member.

* * * * *